US008195074B2

(12) United States Patent
Ishikawa

(10) Patent No.: US 8,195,074 B2
(45) Date of Patent: Jun. 5, 2012

(54) IMAGE FORMING APPARATUS

(75) Inventor: Chuuji Ishikawa, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 12/428,189

(22) Filed: Apr. 22, 2009

(65) Prior Publication Data

US 2009/0279928 A1 Nov. 12, 2009

(30) Foreign Application Priority Data

May 8, 2008 (JP) ..... 2008-122124

(51) Int. Cl.
*G03G 15/20* (2006.01)

(52) U.S. Cl. ..... 399/323; 399/122; 399/297; 399/320

(58) Field of Classification Search ..... 399/107, 399/122, 297, 298, 301, 320–323
See application file for complete search history.

(56) References Cited

U.S. PATENT DOCUMENTS

| | | | | |
|---|---|---|---|---|
| 4,257,054 | A | 3/1981 | Ishikawa | |
| 5,132,740 | A | 7/1992 | Okamoto et al. | |
| 5,893,011 | A * | 4/1999 | Yoshida et al. | 399/203 |
| 6,595,907 | B1 | 7/2003 | Ishikawa et al. | |
| 7,040,806 | B2 | 5/2006 | Ishikawa et al. | |
| 7,363,859 | B2 | 4/2008 | Ishikawa et al. | |
| 2004/0120735 | A1* | 6/2004 | Baba et al. | 399/323 |
| 2007/0147912 | A1* | 6/2007 | Fujii | 399/323 |
| 2008/0193176 | A1* | 8/2008 | Roof | 399/323 |
| 2009/0190980 | A1* | 7/2009 | Tanaka et al. | 399/397 |

FOREIGN PATENT DOCUMENTS

| | | |
|---|---|---|
| JP | 57-46794 | 10/1982 |
| JP | 2876217 | 1/1999 |
| JP | 2005-157179 | 6/2005 |
| JP | 2007-178732 | 7/2007 |
| JP | 2007-187715 | 7/2007 |
| JP | 2007-187791 | 7/2007 |
| JP | 2007-199462 | 8/2007 |
| JP | 2007-206153 | 8/2007 |
| JP | 2007-212922 | 8/2007 |
| JP | 2007-225846 | 9/2007 |
| JP | 2007-233228 | 9/2007 |
| JP | 2007-240920 | 9/2007 |
| JP | 2007-240921 | 9/2007 |
| JP | 2007-248679 | 9/2007 |
| JP | 2008-3277 | 1/2008 |

* cited by examiner

*Primary Examiner* — David Porta
*Assistant Examiner* — Jessica L Eley
(74) *Attorney, Agent, or Firm* — Oblon, Spivak, McClelland, Maier & Neustadt, L.L.P.

(57) ABSTRACT

An image forming apparatus includes an image forming station for forming an image, a registration member, a registration motor, and a fixing unit. The registration member is configured to feed the recording medium in appropriate timing such that a recording medium is aligned with the toner image formed in the image forming station. The registration motor is configured to drive the registration member. The fixing unit is configured to fix the toner image on the recording medium and includes a rotary heating member to heat the recording medium, a rotary pressure member to contact and press against the heating member forming a fixing nip portion where the heating roller and the pressure roller meet, and a sheet separator to eject air to separate the recording medium from the rotary heating member based on a drive signal of the registration motor.

14 Claims, 15 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2008-122124 filed on May 8, 2008 in the Japan Patent Office, the entire contents of which are hereby incorporated herein by reference.

BACKGROUND OF THE INVENTION

1. Field of the Invention

Exemplary aspects of the present invention generally relate to an image forming apparatus, and more particularly, to an image forming apparatus including a fixing unit including a sheet separator using air.

2. Description of the Background Art

Conventionally, a generally known image forming apparatus employs a fixation method using a heating roller. In such a fixation method, heat and pressure are applied to a unfixed toner image on a recording sheet in a fixing nip portion where a pressure roller and a fixing roller including a halogen heater and so forth meet and press against each other while the recording sheet is carried in the fixing nip portion and transported. Such a fixation method is widely used.

Alternatively, there is another known fixation method, known as a belt fixation method, in which an endless fixing belt is wound around and stretched between the heating roller including the halogen heater or the like and the fixing roller.

In this method, the fixing roller is pressed by a pressure roller through the fixing belt, forming the fixing nip. Heat and pressure are applied to the unfixed toner image on the recording sheet in the fixing nip portion where the pressure roller and the fixing belt meet and press against each other while the recording sheet is transported therebetween.

This configuration allows the heat capacity of the fixing belt to be relatively small so that time for warming up can be reduced, resulting in power saving.

With the foregoing configurations, the toner image fused on the recording sheet contacts the fixing roller/belt. For this reason, the surface of the fixing roller or the fixing belt is coated with a material having good releasability, for example, fluororesin, so as to facilitate separation of the recording sheet from the fixing roller/belt. In addition, in order to physically separate the recording sheet from the fixing roller/belt belt, a separation pawl is employed.

However, a drawback to the use of the separation pawl is that, because the separation pawl contacts the fixing roller/belt, the separation pawl may easily scratch the surface of the fixing roller/belt, leaving a scratch mark or a trace thereon. When this happens, the output image has undesirable markings such as streaks.

To counteract this possibility, in general, in a monochrome image forming apparatus, the fixing roller consists of a metal roller the surface of which is coated with Teflon in order to make the surface scratch-resistant. Accordingly, the product life of the fixing roller of this kind is relatively long.

The separation pawl was used for a relatively long time because it was effective to prevent paper jams due to the recording sheet getting wound around the fixing roller.

However, in a case of a color image forming apparatus, in order to improve color enhancement, the fixing roller includes a surface layer formed of silicone rubber coated with fluorine. In general, a tube made of PFA having a thickness of some tens of microns is used for this purpose. Alternatively, the surface of the silicone rubber is coated with oil.

A drawback of the foregoing configuration is that the surface layer is relatively soft and thus damaged or scratched easily. As described above, when there is a scratch on the surface layer, the output image will have streaks.

In view of this, more recent color image forming apparatuses rarely employ the separation pawl or the like that directly contacts the fixing roller to separate the recording sheet from the fixing roller. Instead, such image forming apparatuses employ a contactless separation method.

However, a drawback of the contactless separation method is that it is susceptible to paper jams when the viscosity of the toner and of the fixing roller is relatively high, causing the recording sheet to roll around the fixing roller after fixation. In particular, when a color image is formed, a plurality of color layers is overlaid on one another, increasing viscosity and thus causing paper jams more easily.

One example of a known separation technique employed in the color image forming apparatus uses a contactless separation plate that extends parallel to the fixing roller/belt in a longitudinal or a width direction thereof. A slight gap of approximately 0.2 to 1 mm is provided between the fixing roller/belt and the separation plate.

Another example of a known separation technique uses contactless separation pawls aligned with a predetermined interval between each other. A slight gap of approximately 0.2 to 1 mm is also provided between the fixing roller/belt and the separation pawls.

Still another approach is one in which the recording sheet is separated naturally from the fixing roller/belt using the resilience of the recording sheet itself and elasticity of a curved portion of the fixing roller/belt. This technique is a so-called self-stripping method.

In these known separation methods, a gap is provided between the fixing roller/belt and the separation members. Thus, when a relatively thin recording sheet or the recording sheet having a little or no margin at the leading edge is fed, or a solid image such as a photograph is printed, the recording sheet passes through the gap while sticking tightly to the fixing roller/belt, causing the recording sheet to wind around the fixing roller/belt or contact the separation plate and the separation pawls. As a result, paper jams occur.

In view of the foregoing, in order to help the contactless separation devices to separate the recording sheet from the fixing roller/belt, a method is proposed in which air is blown against a sheet separation area in the vicinity of the fixing nip portion where the pressure roller and the fixing roller/belt meet.

Most air supply mechanisms include a compressor or air pump that compresses air, and air is injected using a solenoid valve that regulates air supply. This configuration allows a relatively large amount of air to be supplied at high pressure.

However, when the compressor is used, the size of the image forming apparatus as a whole increases. In addition, compression of air takes time until a desired high-pressure air is obtained. Consequently, the compressed air cannot be used immediately after the image forming apparatus is turned on.

Furthermore, a solenoid valve is required, thereby increasing the number of parts and thus significantly increasing the cost of the device. Moreover, when the compressor is driven, causing significant noise, it is not suitable for office use. Such an air supply mechanism tends to be large, consuming significant amount of power, thereby defeating the purpose of power saving.

Finally, the typical image forming apparatus using the compressor is a full-color high speed printing machine that tends to be large, expensive, and requiring a dedicated operator.

To address such problems, a compact air supply device is proposed. Further, in order to reliably separate the recording sheet using air, the timing with which the air is ejected must coincide with the arrival of the leading edge of the recording sheet at the proper position within the fixing unit. As with larger air supply devices, with a compact air supply device as well, when air ejection is either too early or too late, the recording sheet does not successfully separate from the fixing roller/belt, causing paper jams.

In order to adjust air supply timing, a detector to detect the leading edge of the recording sheet is proposed. The detector is provided in an area between a sheet feeder and the fixing unit. After a certain time elapses after the detector detects the leading edge of the recording sheet, a solenoid valve is controlled to inject air.

Although this configuration allows the recording sheet to separate reliably, the detector and a driver circuit are necessary, increasing cost as well as the size of the device. Furthermore, paper dust or the like sticks to the surface of the detector after extended use, contaminating the detector and thus necessitating periodical maintenance.

In a case of ejecting air continuously as in the conventional air supply device, the product life is relatively short, and consumption of energy increases.

SUMMARY OF THE INVENTION

In view of the foregoing, in one illustrative embodiment of the present invention, an image forming apparatus includes an image forming station, a registration member, a registration motor, and a fixing unit. The image forming station includes an image bearing member to bear an electrostatic latent image on a surface thereof, a charging device to charge the image bearing member to form the electrostatic latent image, and a developing device to develop the electrostatic latent image formed on the image bearing member using toner to form a toner image. The registration member feeds the recording medium in appropriate timing such that the recording medium is aligned with the toner image formed in the image forming station. The registration motor drives the registration member. The fixing unit fixes the toner image on the recording medium and includes a rotary heating member to heat the recording medium, a rotary pressure member to contact and press against the rotary heating member forming a fixing nip portion where the heating roller and the pressure roller meet, and a sheet separator to eject air to separate the recording medium from the rotary heating member based on a drive signal of the registration motor.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
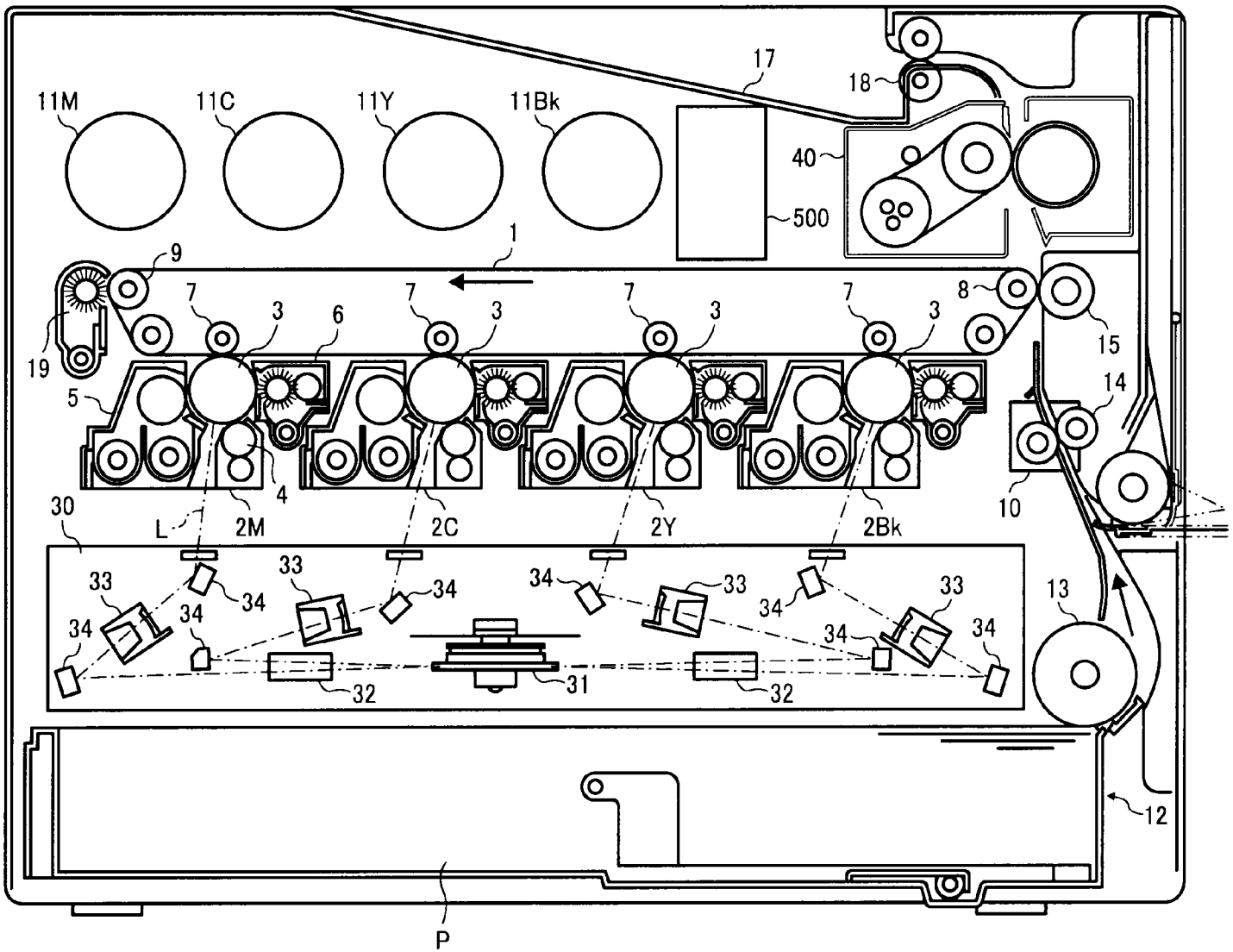
FIG. 1 is a schematic diagram illustrating an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating a tandem-type full-color printer as an example of the image forming apparatus according to the illustrative embodiment. The image forming apparatus in FIG. 1 includes an intermediate transfer belt 1, image forming stations 2M, 2C, 2Y, and 2BK, an exposure unit 30, a sheet cassette 12, a sheet feed member 13, a pair of registration rollers 14, a secondary transfer roller 15, a fixing unit 40, an air supply device 500, and so forth.

Substantially below the intermediate transfer belt 1, the image forming stations 2M, 2C, 2Y, and 2BK are aligned along the intermediate transfer belt 1.

Substantially below the four image forming stations 2M, 2C, 2Y, and 2BK, the exposure unit 30 is disposed. Further below the optical scanner, the sheet cassette 12 is disposed.

At one end of the sheet cassette 12, the sheet feed member 13 is provided. The sheet feed member 13 feeds recording sheets stored in the sheet cassette 12. Substantially above the sheet feed member 13, the pair of registration rollers 14 is provided.

The transfer roller 15 is disposed substantially above the registration rollers 14 and pressed against the intermediate transfer belt 1. The secondary transfer portion is an area where the secondary transfer roller 15 and the intermediate transfer belt 1 meet each other.

Substantially above the secondary transfer portion, the fixing unit 40 is disposed. In FIG. 1, the air supply device 500 is disposed at the left of the fixing unit 40. The air supply device 500 supplies air used for separation of recording sheet in the fixing unit 40.

The upper surface of the image forming apparatus serves as a sheet discharge tray 17 and includes a sheet discharge roller 18 to discharge the recording sheet onto the sheet discharge tray after an image on the recording sheet is fixed.

The four image forming stations for 2M, 2C, 2Y, and 2BK all have the same configuration, except for the color of toner employed. It is to be noted that reference characters M, C, Y, and BK denote colors magenta, cyan, yellow, and black, respectively. Therefore, for simplicity, a description is provided of the image forming station 2M as a representative example of the image forming stations, and the reference character indicating the color is omitted.

The image forming station 2 includes a photoreceptor drum 3 serving as an image bearing member. The photoreceptor drum 3 rotates in a clockwise direction by a driving device, not illustrated. Around the photoreceptor drum 3, a charging roller 4, a developing device 5, a cleaning device 6, and so forth are disposed.

The developing device 5 is a two-component developing device using toner and carrier. A developing sleeve bears the toner and applies the toner to the photoreceptor drum 3.

A transfer roller 7 serving as a primary transfer member is disposed facing the photoreceptor drum 3 through the intermediate transfer belt 1.

The intermediate transfer belt 1 is wound around and stretched by a plurality of rollers, and is rotated in a counterclockwise direction indicated by an arrow. One of the rollers is a roller 8 disposed opposite the secondary transfer roller 15.

Across from the roller 8, another roller, a roller 9, is disposed opposite a belt cleaning device 19 through the intermediate transfer belt 1. The belt cleaning device 19 presses against the intermediate transfer belt 1.

The exposure unit 30 is equipped with a polygon mirror 31, f-θ lenses 32, toroidal lenses 33 and mirrors 34 so as to illuminate the image forming stations with a scan light.

In the image forming station 2M for the color magenta, the charging roller 4 evenly charges the surface of the photoreceptor drum 3 to a predetermined potential.

In the exposure unit 30, based on image data sent from a host machine such as a personal computer or the like, an laser diode (LD), not illustrated, is driven to irradiate a laser beam against the polygon mirror 31. The reflected light is then directed onto the photoreceptor drum 3 through a cylindrical lens or the like so as to form an electrostatic latent image to be developed with a toner of magenta on the photoreceptor drum 3. The electrostatic latent image is developed with the toner of magenta, forming a toner image (visible image) in magenta.

Similar to magenta, toner images of different colors are formed on the surface of the respective color of photoreceptor drums 3. Subsequently, the toner images are overlappingly transferred onto the intermediate transfer belt 1.

The recording sheet is fed from the sheet cassette 12. The recording sheet being fed is transported to the pair of the registration rollers 14 provided substantially upstream in the sheet transport direction, and hits the pair of the registration rollers 14.

The recording sheet is then sent to the secondary transfer portion in appropriate timing such that the recording sheet is aligned with the toner image formed on the photoreceptor drum 3. The secondary transfer roller 15 transfers the toner image onto the recording sheet.

In a case of monochrome printing, only a black toner image is formed on the photoreceptor drum 3 in the image forming station 2BK. The black toner image is then transferred onto the recording sheet.

After the toner image is transferred onto the recording sheet, the toner image is fixed on the recording sheet and the recording sheet is discharged onto the sheet discharge tray 17. At this time, the recording sheet is reversed and discharged upside down, thereby sequentially collating the recording sheets.

Figure 2:
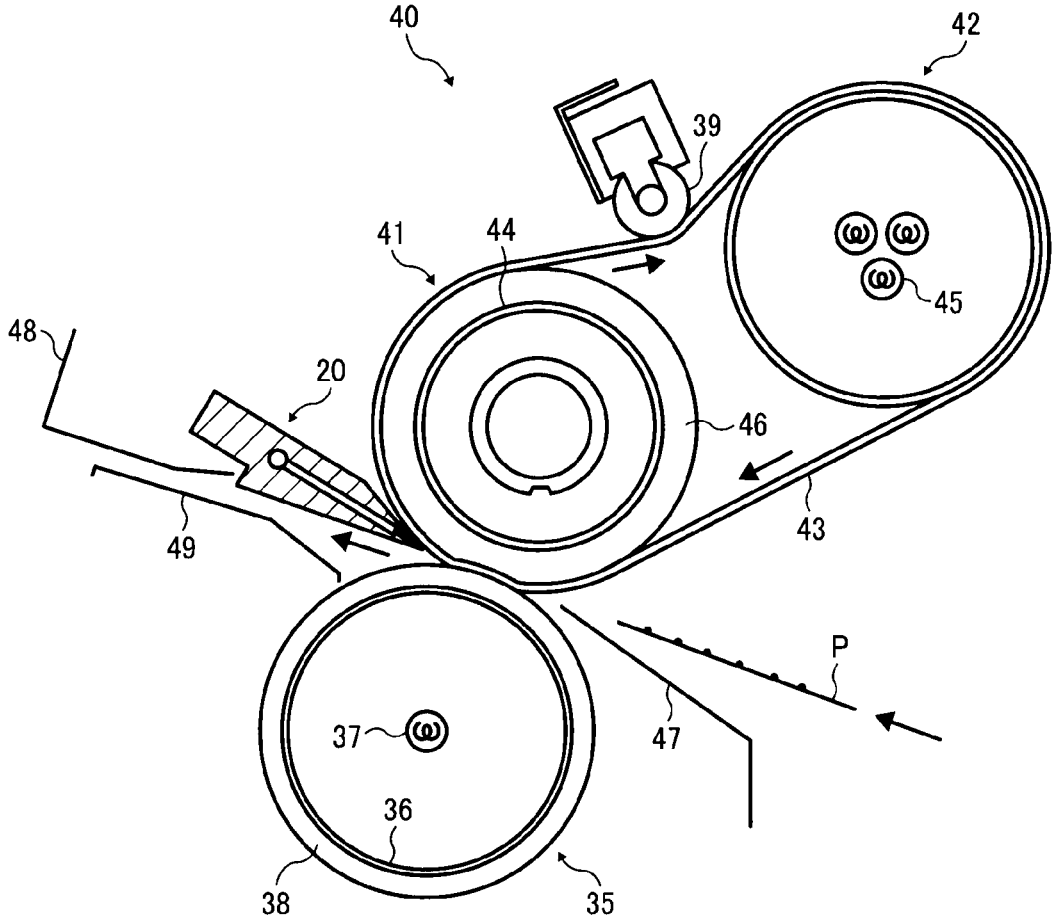
FIG. 2 is a cross-sectional view of a fixing unit employed in the image forming apparatus of FIG. 1 according to an illustrative embodiment of the present invention.
Figure 3:
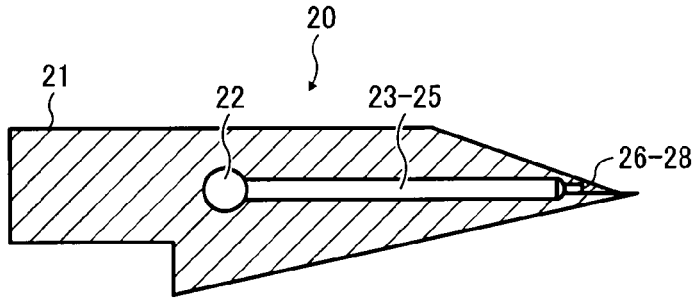
FIG. 3 is a partially enlarged sectional view of a sheet separator according to an illustrative embodiment of the present invention.
Figure 4A:
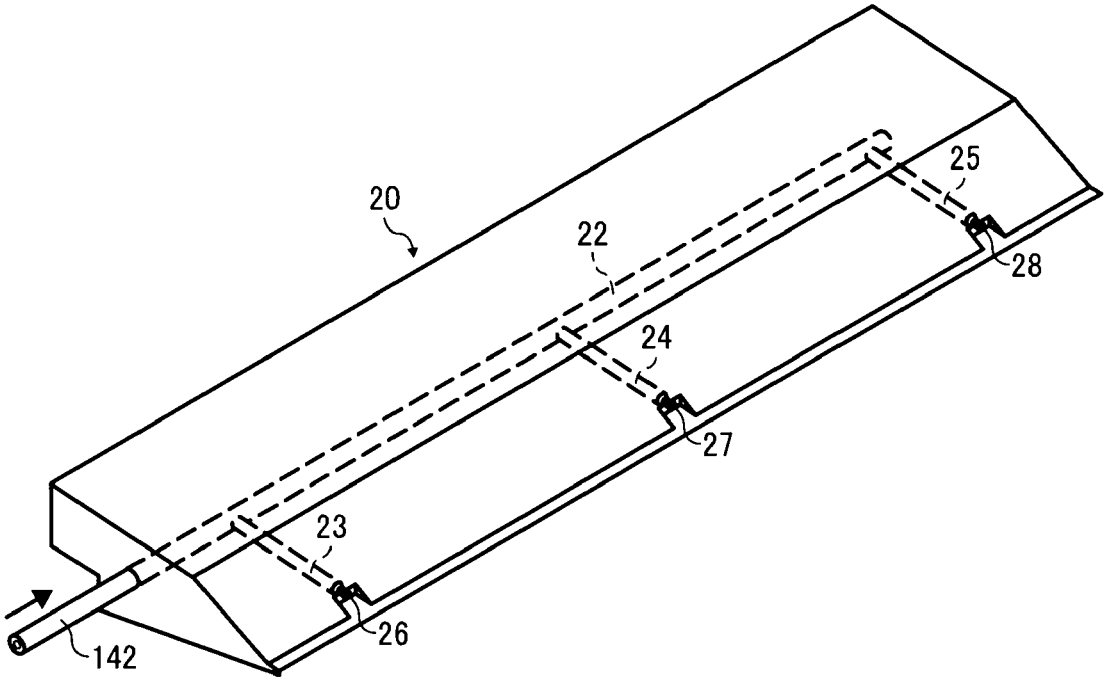
FIG. 4A is a perspective view of the sheet separator according to an illustrative embodiment of the present invention.
Figure 4B:
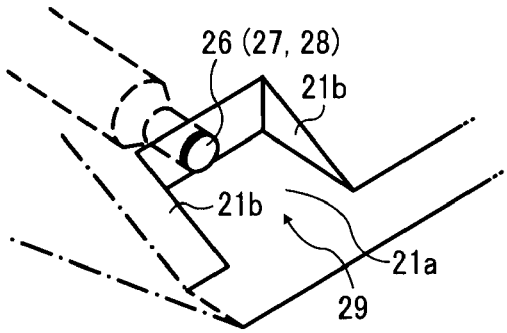
FIG. 4B is a partially enlarged perspective view of a front end of the sheet separator according to an illustrative embodiment of the present invention.

With reference to FIGS. 2 through 4, a description is provided of the fixing unit 40. FIG. 2 is a cross sectional view of the fixing unit 40. FIG. 3 is a partially enlarged cross sectional view of a sheet separator 20. FIG. 4 is a perspective view of the sheet separator 20.

According to the illustrative embodiment, the fixing unit 40 in FIG. 2 employs a belt fixing method. The fixing unit 40 according to the illustrative embodiment employs a belt fixing method that enables a temperature to rise quickly after power is turned on due to small heat capacity of the surface of the belt.

Furthermore, hardness of the surface of the fixing roller is softer than that of the pressure roller. That is, the rubber layer of the fixing roller is relatively thick, so that the recording sheet that exits the fixing nip portion between the fixing roller and the pressure roller falls downward, thereby facilitating the recording sheet to separate from the fixing roller/belt.

Alternatively, as long as releasability of a sheet separator described later can be maintained, the surface hardness of the fixing roller and the pressure roller can be similar, or if not the same, and the recording sheet can be discharged from the roller fixing nip portion in a direction of tangent.

As illustrated in FIG. 2, the fixing unit 40 includes a fixing roller 41, a heating roller 42 including three heaters 45 inside thereof, a fixing belt 43, and so forth. The three heaters 45 in the heating roller 42 heat the surface of the fixing belt 43.

Subsequently, in the fixing nip portion where the fixing roller 41 and the pressure roller 35 meet and press each other, the surface of the fixing belt 43 being heated heats and presses unfixed image on the recording sheet. Accordingly, the image is fixed.

According to the illustrative embodiment, the fixing belt 43 includes a base material of polyimide film covered with a silicone rubber layer.

The fixing roller 41 includes a core metal 44. The surface of the core metal 44 includes a rubber layer 46.

The fixing belt 43 is wound around the fixing roller 41 and the heating roller 42, and stretched at a predetermined tension by a belt tension member 39.

The pressure roller 35 includes a core metal 36 and a heater 37 inside thereof. The surface of the core metal 36 includes a rubber layer 38. The heater 37 is provided so as to heat the fixing nip portion from the pressure roller 35, thereby preventing the temperature of the fixing nip portion from decreasing.

In order to enhance heat resistance and color of an image, the rubber layers 46 and 38 are formed of silicone rubber. By changing thickness of the rubber layers, in particular, by forming a thickness of the rubber layer 46 of the fixing roller 41 substantially thicker than the rubber layer 38 of the pressure roller 35, the rubber layer 38 sinks into the fixing roller 51.

According to the illustrative embodiment, the surface of both the fixing belt 43 and the pressure roller 35 is formed of silicone rubber having some viscosity. Thus, silicon oil is slightly supplied on the belt surface so as to facilitate separation of a recording sheet P therefrom.

Substantially upstream the fixing nip portion, a guide board 47 is provided to guide the recording sheet P to the fixing nip portion.

After the recording sheet P exits the fixing nip portion, the recording sheet P is guided substantially below the sheet separator 20 and passes between the sheet separator 20 and a lower guide 49. Subsequently, the recording sheet P is discharged through an upper guide 48 and the lower guide 49.

With reference to FIGS. 3 and 4, a description is provided of the sheet separator 20 according to the illustrative embodiment. FIG. 3 is a partially enlarged cross-sectional view of the sheet separator 20. FIG. 4 is a perspective view of the sheet separator 20.

According to the illustrative embodiment, as illustrated in FIG. 3, the sheet separator 20 includes a nozzle main body 21 and a conduit 22 inside thereof. The conduit 22 extends in a longitudinal direction of the sheet separator 20.

As illustrated in FIG. 3, the conduit 22 includes divergent paths 23, 24, and 25 substantially at both ends and the center of the conduit 22. Each of the divergent paths 23, 24, and 25 extends to tips of nozzles.

The front ends of the divergent paths 23, 24, and 25 include nozzles 26, 27, and 28 from which air is supplied, respectively. Each of the nozzles 26, 27, and 28 has a small diameter.

As illustrated in FIG. 3, the front end portion of the nozzle main body 21 has an substantially acute angle in cross section. At the end of each of the nozzles 26, 27, and 28, an opening 29 is provided. A bottom surface 21*a* and side walls 21*b* of the nozzle main body 21 surround the opening 29 to prevent air supplied from the nozzles 26, 27, and 28 from dissipating, thereby concentrating the direction of ejection and thus enhancing the impact of the air.

One end of the conduit 22 in the longitudinal direction thereof is connected to the lateral (side) surface of the nozzle main body 21 and is opened. A tube 142 is attached to the end of the conduit 22. The tube 142 is connected to an air outlet 141, later described, of the air supply device 500, so as to eject air supplied from the air supply device 500 through the nozzles 26, 27, and 28, thereby separating the recording sheet discharged from the fixing nip portion using air.

According to the illustrative embodiment, three sides of the opening 29 of each of the nozzles 26, 27, and 28 are surrounded by the bottom surface 21*a* and side walls 21*b* so that air ejected from the nozzles 26, 27, and 28 can be directed straight to the fixing nip portion enhancing the impact of the air pressure against the recording sheet P. Accordingly, the recording sheet can be reliably separated.

Next, a description is provided of air supply timing of the sheet separator 20.

The present inventor performed an experiment in which a sheet transport time for the recording sheet P to travel from the registration roller 14 to the fixing nip portion was studied using the image forming apparatus illustrated in FIG. 1.

Figure 5:
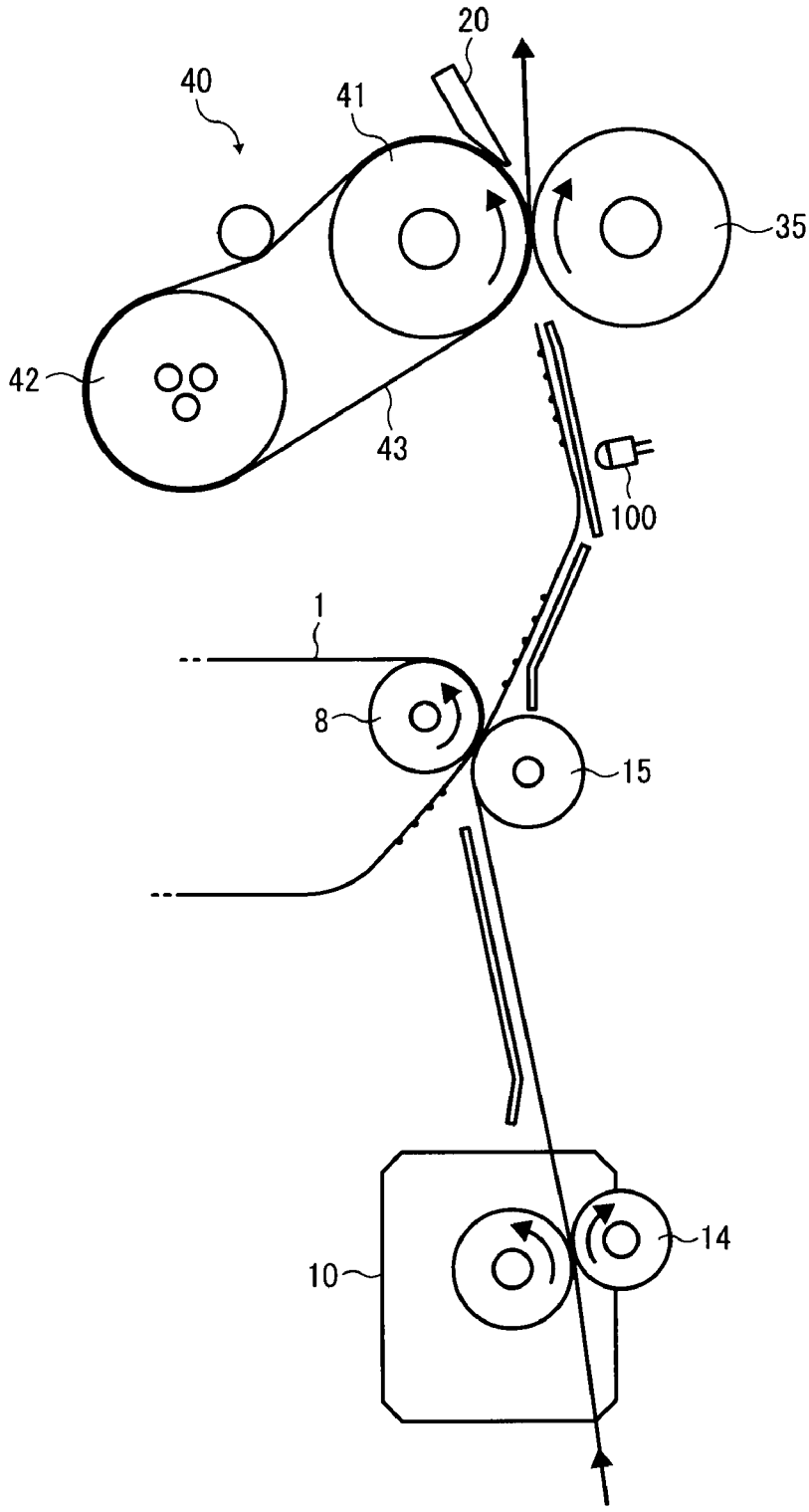
FIG. 5 is a schematic diagram illustrating a configuration for experiments in which a sheet transport time from a registration roller to a fixing nip portion was measured.

In the experiment, as illustrated in FIG. 5, a detector 100 was provided before the fixing unit 40 to measure how long it takes for the recording sheet to arrive at the detector 100 from the registration roller 14. Five sheets of standard paper were used for each measurement. Three measurements were performed and the results shown in Table 1.

As indicated in Table 1, an average time for the recording sheet P to arrive at the detector 100 from the registration roller 14 was 0.74 seconds. In terms of a value for $+-3\sigma$ (three times the standard deviation), the variation fell within approximately 8 ms.

It is to be noted that, although not indicated herein, when the experiment was performed using relatively thick paper and relatively thin paper, the variation fell within approximately 10 ms in terms of the value for $+-3\sigma$ for all the sheets.

Another experiment was performed to examine whether or not the recording sheet could be separated by ejecting air from the sheet separator 20 at a constant or fixed timing even if the sheet transport timing varied as indicated above.

In this experiment, a time T1 was gradually varied. T1 is an elapsed time starting from detection of an ON-signal from a registration motor 10 that drives the registration roller 14 to when the air supply unit 500 started operation. A time range within which the recording sheet separated was measured.

It is to be noted that, as a parameter, a piston speed or a speed of an air pump, that is, the number of strokes of the piston per minute was varied, and the experiment was performed at three different piston or pumping speeds.

The results of the experiment are shown in Table 2. The letter symbol "Y" indicates that the recording sheet was successfully separated; whereas, "N" indicates that the recording sheet was not separated.

As indicated in Table 2, in a case in which the piston speed was at 120-strokes per minute, that is, the piston moved back and forth 120 times per minute, the recording sheet was separated when T1 was between 0.70 and 0.77 seconds. In other words, the time range in which the recording sheet was separated is 70 ms.

In a case in which the piston speed was 130-strokes per minute, the recording sheet was separated when T1 was between 0.74 and 0.83 seconds. In other words, the time range in which the recording sheet was separated was 90 ms.

In a case in which the piston speed was 140-strokes per minute, the recording sheet was separated when T1 was between 0.72 and 0.84 seconds. In other words, the time range in which the recording sheet was separated was 120 ms.

Based on the experiment, when the piston speed was at 140-strokes per minute, a margin of separation was the largest.

Because air pressure of the air ejection increases as the piston speed is increased, the impact of air against the recording sheet increases (separation ability is increased). The more air is ejected between the recording sheet and the fixing roller/belt, the easier the recording sheet can be separated from the fixing roller/belt.

In a case in which the piston speed of the air supply device 500 is set at 140-strokes per minute and the variations in the sheet transport time as previously shown in Table 1 are taken into consideration, when operation of the air supply device 500 is initiated at a median of margin of separation 120 ms (T1=0.78 sec), a margin of separation of 100 ms can be secured even if a variation of 10 ms is included at both sides of median of the margin.

Therefore, despite unit-to-unit variation and variation in operating environment such as temperature, the recording sheet can be reliably separated.

According to the experiment, when the operation timing of the air supply device 500, that is, air supply timing is configured based on the ON-signal of the registration motor 10, the range of variation in the transport time of the recording sheet to the fixing nip portion is approximately +−10 ms. Thus, the recording sheet can be reliably separated.

According to the illustrative embodiment of the present invention, air supply against the recording sheet can be regulated based on the drive signal of the registration motor 10, thereby eliminating the need for a detector dedicated for detection of the recording medium anterior to the fixing portion.

According to the illustrative embodiment, when the piston speed of the air supply device 500 is configured to be 140-strokes per minute, for example, the air supply device 500 can be initiated after 0.78 seconds after initialization of the registration motor 10.

According to the experiments described above, the variation was measured by measuring the time when the recording sheet arrived at the position anterior to the fixing nip portion, instead of at the center of the nip portion. This is because an approximate air supply timing or initialization of the air supply device 500 needed to be studied. Thus, the detector 100 was provided solely for the purpose of measuring the air supply timing, not to turn on the air supply device 500 by detecting the recording sheet.

Figure 6:
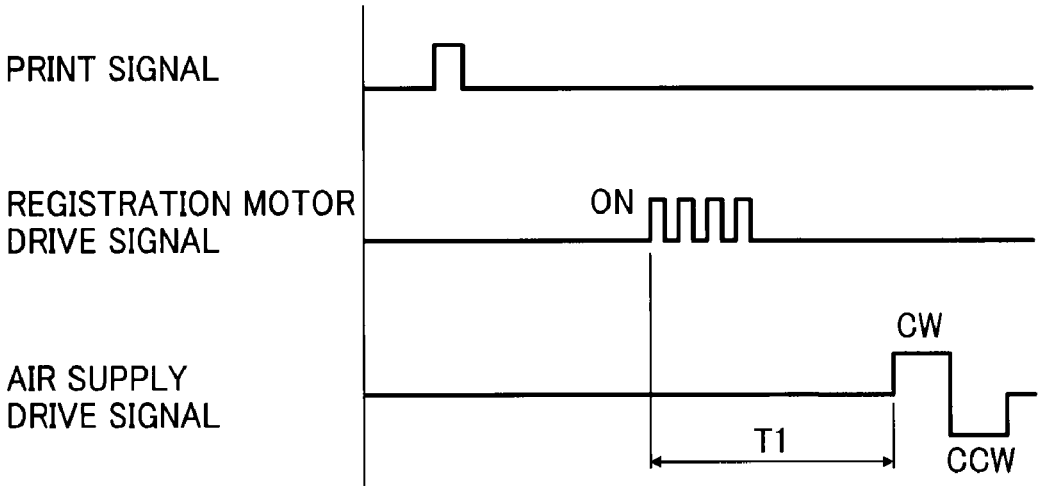
FIG. 6 is a timing chart of air supply control according to an illustrative embodiment of the present invention.

Referring now to FIG. 6, there is provided a timing chart for control of air supply. As indicated in FIG. 6, when printing is instructed, image formation in the image forming stations is initialized and the recording sheet is fed from the sheet cassette. The drive signal for the registration motor 10 is turned on.

When the registration motor 10 is turned on and the time T1 elapses, the air supply device 500 starts to operate, enabling the sheet separator 20 of the fixing unit 40 to eject air. Accordingly, the recording sheet can be reliably separated from the fixing roller 41 or the fixing belt 43. It is to be noted that in FIG. 6, CW refers to a clockwise rotation and CCW refers to a counterclockwise rotation.

It is to be noted that T1 is set depending on the piston speed (pumping speed) of the air supply device 500, the distance between the registration roller 14 to the fixing nip portion, and the sheet transport speed. According to the experiments using the configuration of the present invention, when T1 was 0.78 seconds, the recording sheet was reliably separated.

According to the experiments, a distance Ls between the registration roller 14 to the detector 100 is approximately obtained based on the drawing, Ls=150.5 mm, and the sheet transport speed (linear speed) is 205 mm/s. Therefore, the sheet arrival time Ts (from the registration roller 14 to the detector 100) can be calculated as: Ts=150.5/205=0.73 seconds. According to the experiments described above, the average is 0.74 seconds, which closely corresponds to Ts when taking the start-up time of the registration motor 10 into consideration. Furthermore, the range of variation falls within approximately 10 ms in terms of the +−3σ value, which is relatively stable considering curves of the sheet transport path.

According to the experiments described above, the optimum timing with which the sheet separator 20 ejects air was when the leading edge of the recording sheet arrived at a position substantially downstream from the detector 100 (toward the fixing nip portion) but before the beginning of the nip. This indicates that the T1 to be set as the air supply timing is 0.78 seconds, which is relatively a large value when compared with the arrival time Ts of 0.73 seconds (Ts=0.73 sec) for the recording sheet to arrive at the detector 100 (the average was 0.74 in the experiments). This means that the position of the leading edge of the recording sheet is substantially downstream from the detector 100.

In the image forming apparatus of FIG. 1 used in the experiments, the distance to the center of the fixing nip portion is 193.5 mm, and the sheet arrival time Tn is 0.94 seconds (Tn=193.5/205=0.94 seconds). When the optimum air supply timing is set to T1=0.78 seconds, the position of the leading edge of the recording sheet is substantially before the fixing nip portion at the time of air supply.

That is, when the air supply device 500 is initialized immediately before the recording sheet advances to the fixing nip portion (approximately 0.2 seconds according to the illustrative embodiment), the recording sheet can be reliably separated even if the sheet arrival time to the fixing nip varies.

According to the illustrative embodiment, a stepping motor is used as the registration motor 10. In the stepping motor, a motor rotates in accordance with the number of input pulses, and its waveform is a square wave. Thus, the input signal can be read with precision. As described later, the drive source of the air supply device includes the stepping motor as well.

A description is provided of separation of the recording sheet and effect of a sheet margin at the leading edge of the recording sheet. The separability of the recording sheet changes with the size of the sheet margin at the leading edge, that is, an area at the edge of the sheet where no image is formed.

When the recording sheet includes a toner image substantially at the leading end thereof or the image density is relatively high at the leading edge, adhesion of the recording sheet to the fixing member increases, thereby degrading separability. That is, the recording sheet easily sticks to the fixing member.

By contrast, when the recording sheet does not include a toner image substantially at the leading edge thereof, adhesion of the recording sheet to the fixing member is not significant so that the recording sheet does not easily stick to the fixing member.

Ordinarily, air is ejected only when the image density at the leading edge of the recording sheet is equal to or greater than a predetermined value or when printing an image on the recording sheet without any margins. However, it is difficult to measure the image density accurately, and moreover, it is difficult to determine where in the image the image density should be checked. Furthermore, although the detection of an image without any margins is relatively easy, in general most images (recording objects) include margins. Thus, controlling air supply by detecting the image density at the leading edge of the recording sheet is neither realistic nor cost effective.

By contrast, the illustrative embodiment measures not the image density at the margin but the margin itself. Detecting the size of the margin at the leading edge of the recording sheet is easier than detecting the density of an image. The size of the margin at the leading edge can be easily detected when the image of the document is read by a scanner in a copier. In a case of a printer, the size of the margin at the leading edge of the recording medium can be easily detected based on information on the margin in document setting transmitted from a host machine such as a personal computer.

Thus, according to the illustrative embodiment, when a margin at the leading edge of the recording sheet in the sheet transport direction is less than a predetermined value, the air supply device 500 is driven so as to enable the sheet separator 20 to supply air.

By contrast, when a margin at the leading edge of the recording sheet is equal to or greater than a predetermined value, the air supply device 500 is not driven so that the sheet separator 20 does not eject air.

With the above-described configuration, both reliable sheet separation and enhancement of product life can be achieved as described below.

Figure 7:
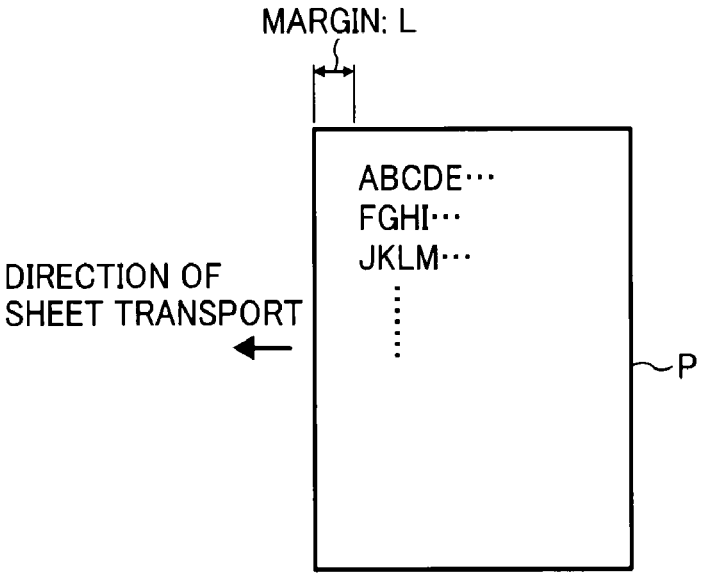
FIG. 7 is a schematic diagram for explaining a sheet margin at a leading edge of a recording sheet.

Referring now to FIG. 7, there is provided a schematic diagram for explaining the sheet margin at the leading edge of the recording sheet.

In FIG. 7, a margin L is a distance between the leading edge of the recording sheet P in the direction of the sheet transport and an image.

For example, when the predetermined value of the margin L is 6 mm and L is less than 6 mm, the air supply device 500 is driven, enabling the sheet separator 20 to eject air.

By contrast, when L is equal to or greater than 6 mm, the air supply device 500 is not driven so that the sheet separator 20 does not eject air. When ejecting no air, the sheet separator 20 serves as a separation pawl.

In the experiment performed by the present inventor, when the sheet margin L was equal to or greater than 6 mm, the recording sheet separated without air supply. In general, the margin of the recording sheet is most likely not less than 6 mm.

Thus, when compared to a case in which air is ejected against all recording sheets, the required air supply is significantly less in the present invention, thereby enhancing product life of the air supply device 500.

Next, as a separate matter, the recording sheet may get wound around not only the fixing roller, but also around the pressure roller. For this reason, the sheet separator 20 can be provided adjacent to the pressure roller 35 so that the recording sheet can be separated therefrom using air.

In duplex printing in particular, when the sheet separator 20 is provided adjacent to both the fixing roller and the pressure roller, the recording sheet is prevented effectively from getting wound therearound.

In duplex printing, the preceding surface of the recording medium on which the image is fixed moves to the pressure roller when the next fixing is performed, that is, when the other side is fixed. Consequently, the recording sheet may easily wind around the pressure roller 35.

However, when the sheet separator 20 is provided adjacent to the pressure roller 35, the recording sheet is prevented from getting wound around the pressure roller 35. Similar to the sheet separator 20 at the fixing roller 41, air supply of the sheet separator 20 provided adjacent to the pressure roller 35 can be controlled based on the drive signal of the registration motor 10.

Referring back to FIG. 2, in order to prevent the recording sheet from getting wound around the fixing roller 41, the pressure roller 35 is configured to sink into the fixing roller 41 so as to facilitate separation of the recording sheet from the fixing roller 41 side.

However, when the sheet separator 20 is provided to both the fixing roller 41 and the pressure roller 35, the fixing roller 41 and the pressure roller 35 can deform evenly, thereby discharging the recording sheet in the tangent direction. Pressure can be evenly exerted in the fixing nip portion, thereby preventing cockling of sheet.

When the small-size air supply device 500 described later is employed in the image forming apparatus that does not have much space for parts, air can still be supplied to each sheet separator 20 provided at both the fixing roller 41 and the pressure roller 35, and the recording sheet can be reliably separated, preventing paper jams.

A single air supply device 500 can supply air to each sheet separator 20 provided at both the fixing roller 41 and the pressure roller 35 by appropriately setting an amount of air supplied by the air supply device.

According to the illustrative embodiment, air supply is controlled based on the drive signal of the registration motor, thereby eliminating a dedicated detector for detecting the recording sheet before the fixing unit. The air can be ejected against the recording sheet in appropriate timing so as to separate the recording sheet from the fixing member and so forth.

With this configuration, the cost can be reduced while the recording sheet is reliably separated using air. Furthermore, since the sheet detector is not necessary, maintenance for the detector is not necessary as well, reducing maintenance cost. Air is only ejected when the margin at the leading edge of the recording sheet is equal to or less than the predetermined value, thereby enhancing product life and saving energy.

The air supply device may use a known air supply system using a compressor, for example. However, when a small-size low-price air supply device according to the illustrative embodiment described later is employed, a generally known image forming apparatus used often in an office can still appreciate reliable sheet separation using air.

With reference to FIGS. 8 through 13, a description is provided of the air supply device employed in the image forming apparatus according to the illustrative embodiment.

Figure 8:
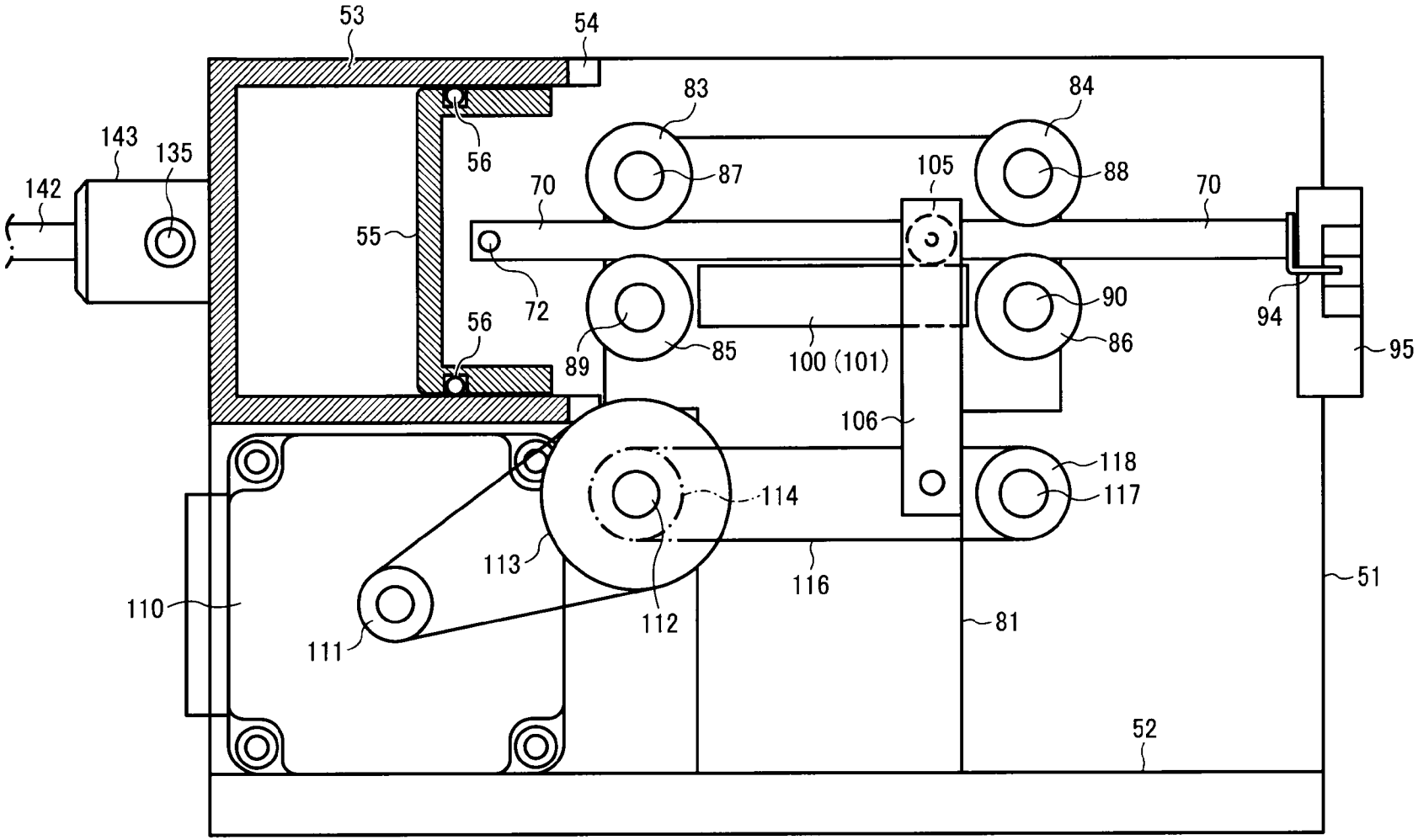
FIG. 8 is a front cross-sectional view of an air supply device according to an illustrative embodiment of the present invention.
Figure 9:
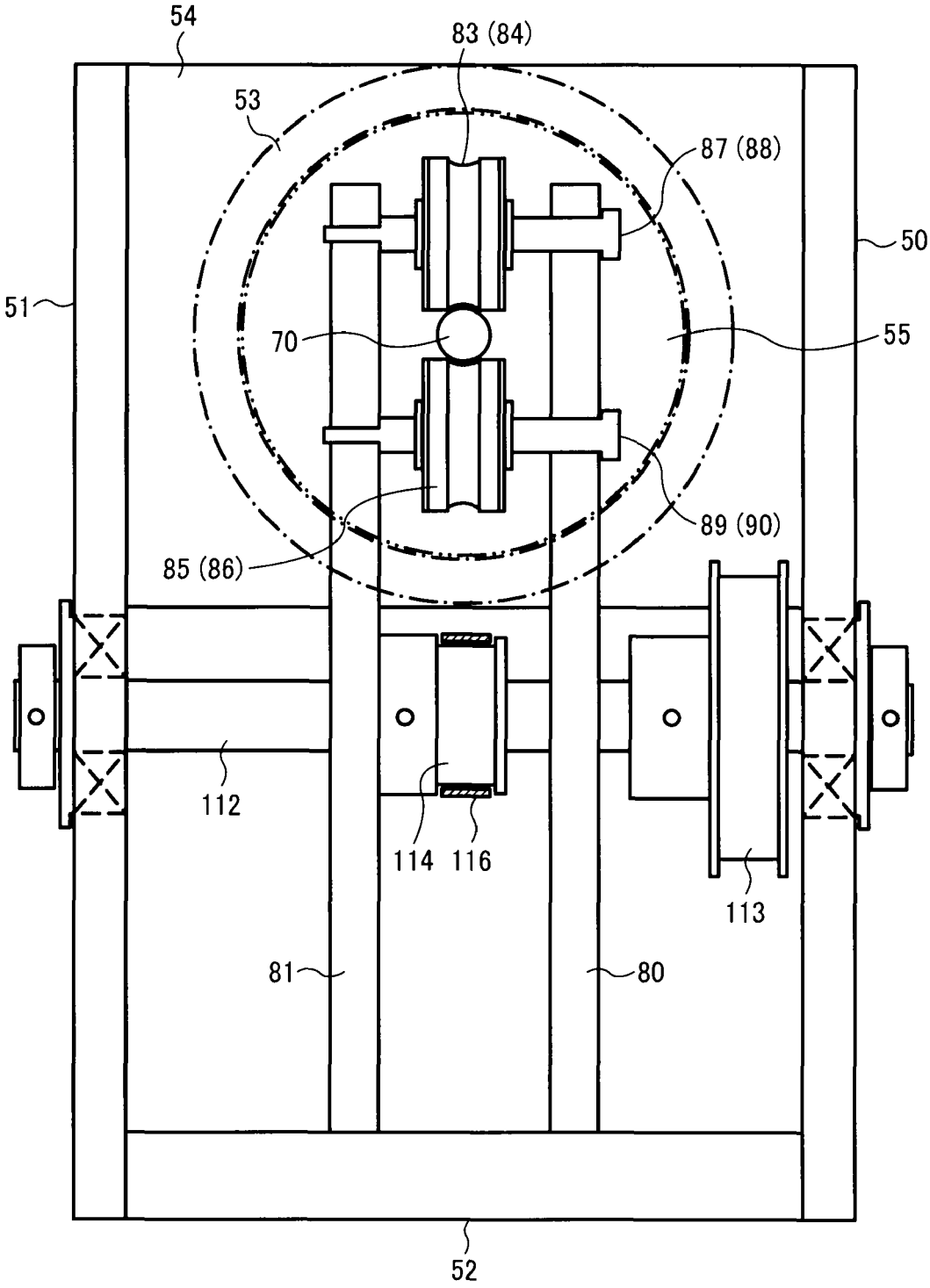
FIG. 9 is a side cross-sectional view of the air supply device of FIG. 8 according to an illustrative embodiment of the present invention.
Figure 10:
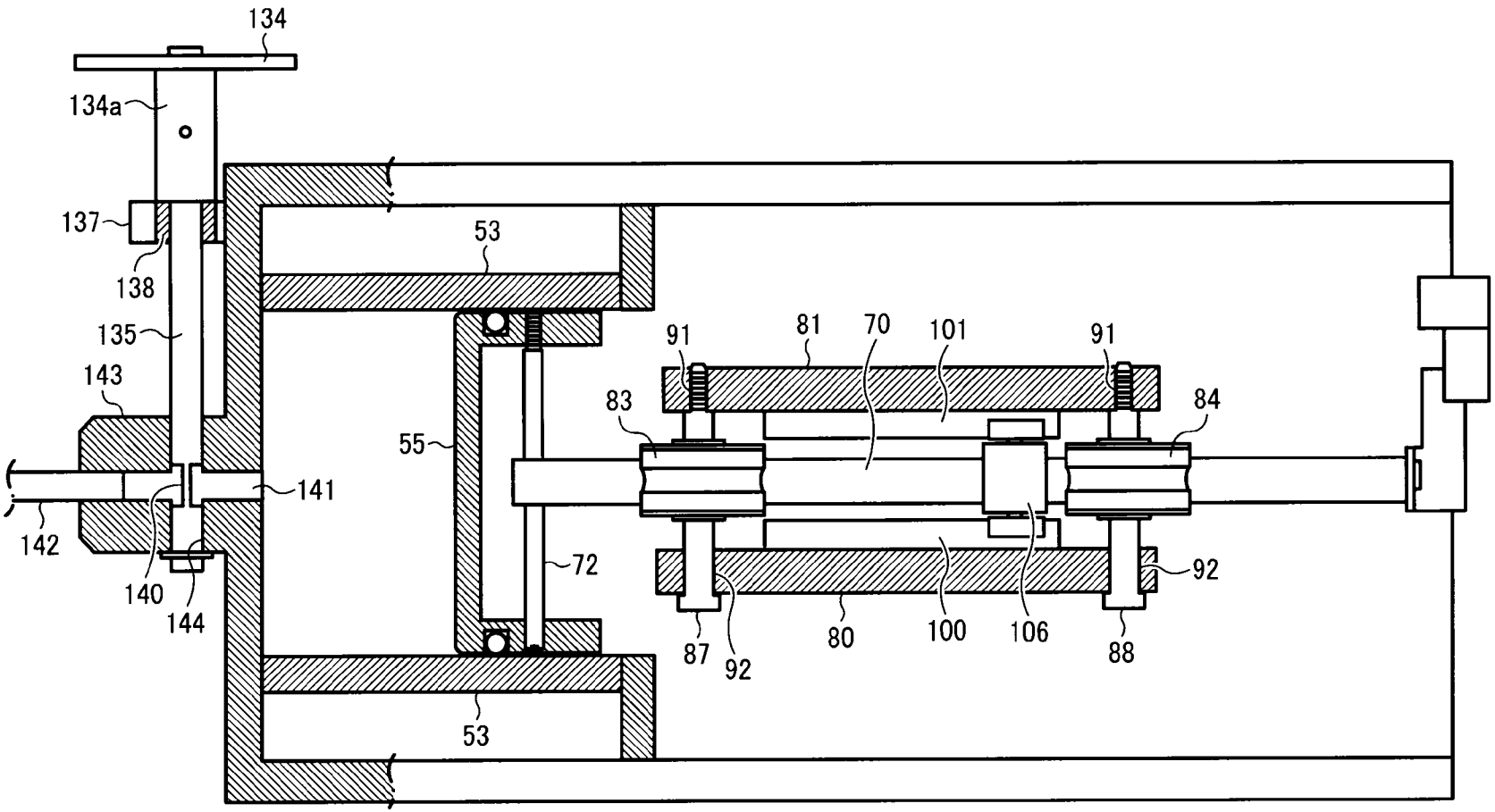
FIG. 10 is a horizontal cross-sectional view of a pump in the air supply device according to an illustrative embodiment of the present invention.
Figure 11:
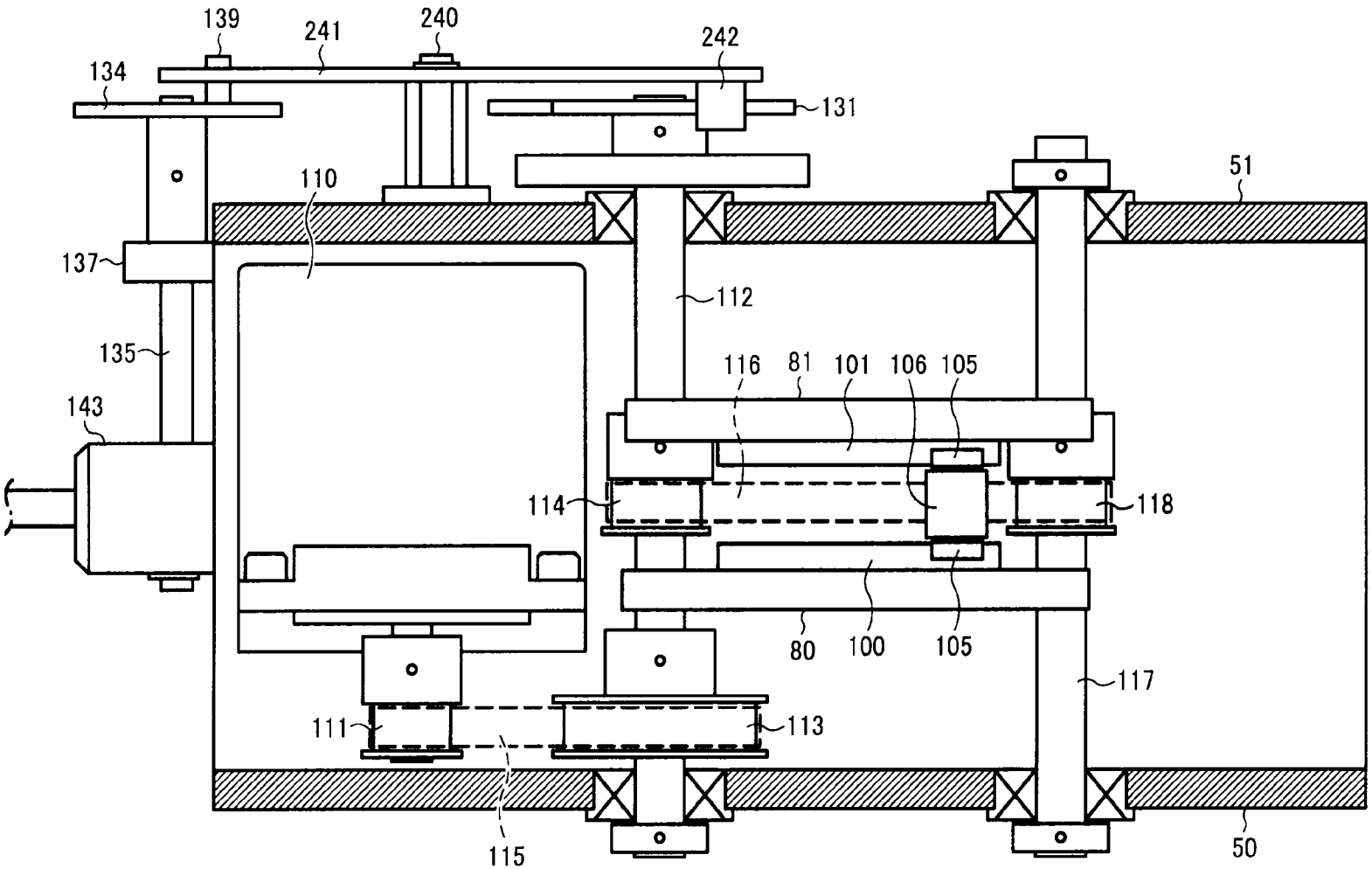
FIG. 11 is a horizontal cross-sectional view of a drive mechanism of the air supply device according to an illustrative embodiment of the present invention.
Figure 12:
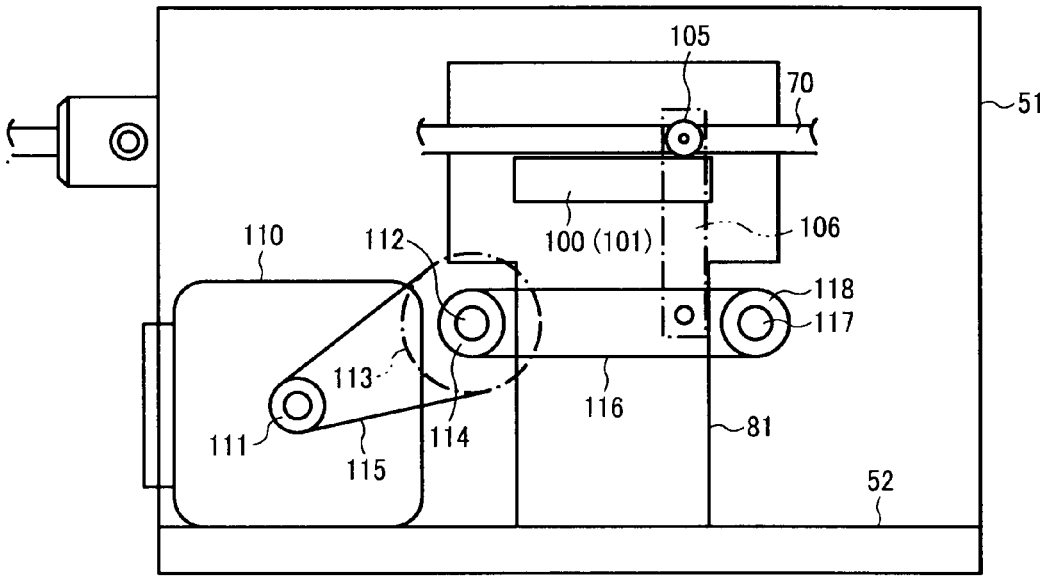
FIG. 12 is a front cross-sectional view of the air supply device according to an illustrative embodiment of the present invention.
Figure 13:
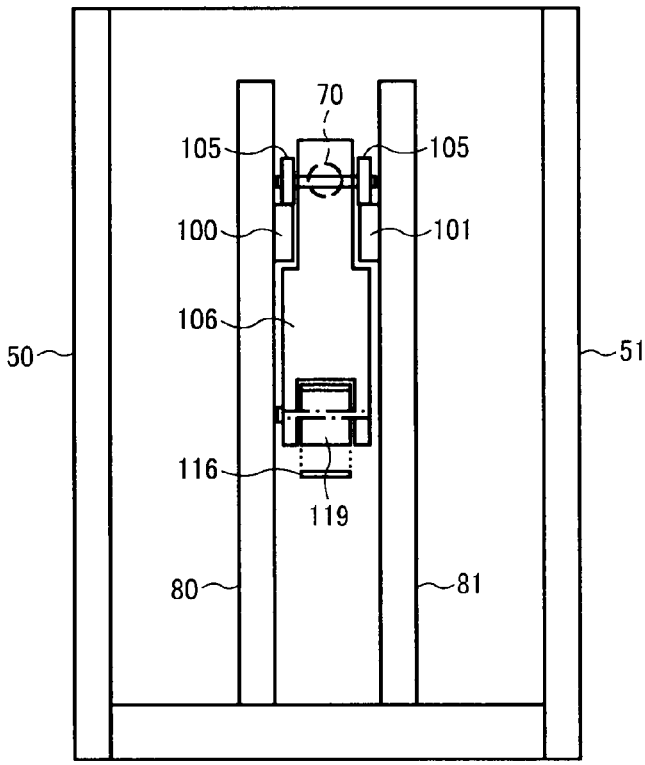
FIG. 13 is a side cross-sectional view of the air supply device as viewed from the right in FIG. 1 according to an illustrative embodiment of the present invention.

FIG. 8 is a vertical sectional view of the air supply device as viewed from the front thereof. FIG. 9 is a vertical sectional view of the air supply device of FIG. 8 as viewed from the left side thereof. FIG. 10 is a horizontal sectional view of the pump the air supply device. FIG. 11 is a horizontal cross-sectional view of a drive unit of the air supply device. FIG. 12 is a vertical sectional view of the drive unit as viewed from the front (some parts are omitted). FIG. 13 is a vertical sectional view of the drive unit as viewed from the right.

As illustrated in FIG. 9, the air supply device 500 includes a front panel 50, a rear panel 51, and a bottom panel 52. Between the front panel 50 and the rear panel 51, a cylinder 53 and a cylinder retainer 54 are secured to the front panel 50 and the rear panel 51 by fastening means. In this case, the fastening means are screws. The cylinder retainer 54 supports the cylinder 53 substantially from the back thereof.

In the cylinder 53, a piston 55 is provided and reciprocally moves to the left and to the right in FIG. 8 by a later described mechanism. The cylinder 53 includes a boss 143 at the front end surface thereof. The boss 143 protrudes therefrom as illustrated in FIG. 10.

As illustrated in FIG. 10, an air outlet 141 is provided inside the boss 143 so as to eject air from inside the cylinder 53. A tube 142 is fitted substantially to the front end of the air outlet 141. When the piston 55 moves, air inside the cylinder 53 compressed by the piston 55 is injected outside through the air outlet 141 and the tube 142.

The following description pertains to the configuration and operation of the air supply device 500 according to the illustrative embodiment.

As illustrated in FIG. 9, on the bottom panel 52, a pair of retaining plates 80 and 81 is vertically provided. Four rod shafts 87 through 90 are provided to the retaining plates 80 and 81.

As illustrated in FIG. 9, one end of each of the rod shafts 87 through 90 includes a screw portion, and the other end has a relatively large diameter so as to prevent the rod shafts from falling. Grooves are formed on the surface of the end surface having the large diameter so that the rod shafts 87 through 90 are fastened by using a driver or the like.

Four screw holes 91 are provided to the retaining plate 81. Four fitting holes 92 are provided to the retaining plate 80.

Each of the rod shafts 87 through 90 are inserted into the fitting holes 92 of the retaining plate 80 and through the screw holes 91 of the retaining plate 81, and fastened, thereby securely fixing the rod shafts 87 through 90 between the retaining plate 80 and 81.

Guide rollers 83 through 86 are rotatably mountable to each of the rod shafts 87 through 90 and positioned in a shaft direction by E-type retaining rings provided to each of the rod shafts 87 through 90 at both sides of the guide rollers 83 through 86.

As illustrated in FIGS. 9 and 10, the diameter of the center of the guide rollers 83 through 86 in the shaft direction is smaller than the diameter at both sides thereof. The portion of the guide rollers having the small diameter has an R-shape groove (depression) to accommodate an outer shape of a guide shaft 70. According to the illustrative embodiment, the outer shape of the guide shaft 70 is circular in cross section.

Alternatively, the substantially the center portion of the guide rollers 83 through 86 has a V-shape groove or depression.

The guide shaft 70 is provided between the guide rollers 83 through 86, each disposed at the top, the bottom, the left and the right. The guide shaft 70 is guided by the guide rollers 183 through 186 so as to be able to linearly and reciprocally move between the left and the right directions in FIGS. 8 and 10.

In order to prevent the guide rollers 83 through 86 and the guide shaft 70 from rattling when the rod shafts 87 through 90 are mounted to the screw holes 91 and the fitting holes 92, the screw holes 91 and the fitting holes 92 are accurately positioned relative to the retaining plates 80 and 81 so that the guide shaft 170 can move smoothly.

As described above, since the guide rollers 83 through 86 support the guide shaft 70 from both the top and the bottom and the guide rollers 83 through 86 are positioned in the shaft direction by the E-type retaining rings relative to the rod shafts 87 through 90, the guide shaft 70 is prevented from drifting in the front and the back directions or in the vertical direction as the guide shaft 70 travels. With this configuration, the guide shaft 70 is enabled to accurately and linearly travel. In the present embodiment, the guide shaft 70 travels horizontally.

A description is now provided of the piston 55 in the cylinder 53. Referring back to FIG. 8, the piston 55 provided inside the cylinder 53 is mounted substantially at the front end of the guide shaft 70, that is, substantially at the left end in FIG. 8, through a rod 72.

A groove is formed in the vicinity of the tip portion of the piston 55, and an C-ring 56 is fitted thereto. Substantially at the rear end of the guide shaft 70, that is, substantially at the right end in FIGS. 8 and 10, a filler 94 is fastened by a screw. The filler 94 detects the position of the piston 55.

A detector 95 is a transmissive-type optical sensor that detects the filler 94. When the guide shaft 70 travels in the right direction in FIG. 8 (10) and the tip of the filler 94 blocks the light of the detector 95, a drive motor, later described, is halted. According to the illustrative embodiment, FIGS. 8 and 10 illustrate a home position of the pump.

According to the illustrative embodiment, the cylinder 53 and the piston 55 have a cylinder shape. As described above, the guide shaft 70 accurately linearly travels so that the piston 55 moves reciprocally (parallel) in the cylinder 53.

As a pump, the piston needs to move linearly or parallel. In addition, it is important to prevent rotation of the piston. If the piston 55 rotates, causing the guide shaft 70 to rotate, the filler 94 also rotates. Consequently, the filler 94 does not come in view of detection field of the detector 95 and thus collides against the detector 95. Furthermore, since the present invention employs the belt driving method, the drive belt may tilt, thus causing instability in driving.

To address such problems, according to the illustrative embodiment, the piston 55 is prevented from rotating. As illustrated in FIG. 10, rails 100 and 101 are provided facing the upper surface of the retaining plates 80 and 81.

Figure 14:
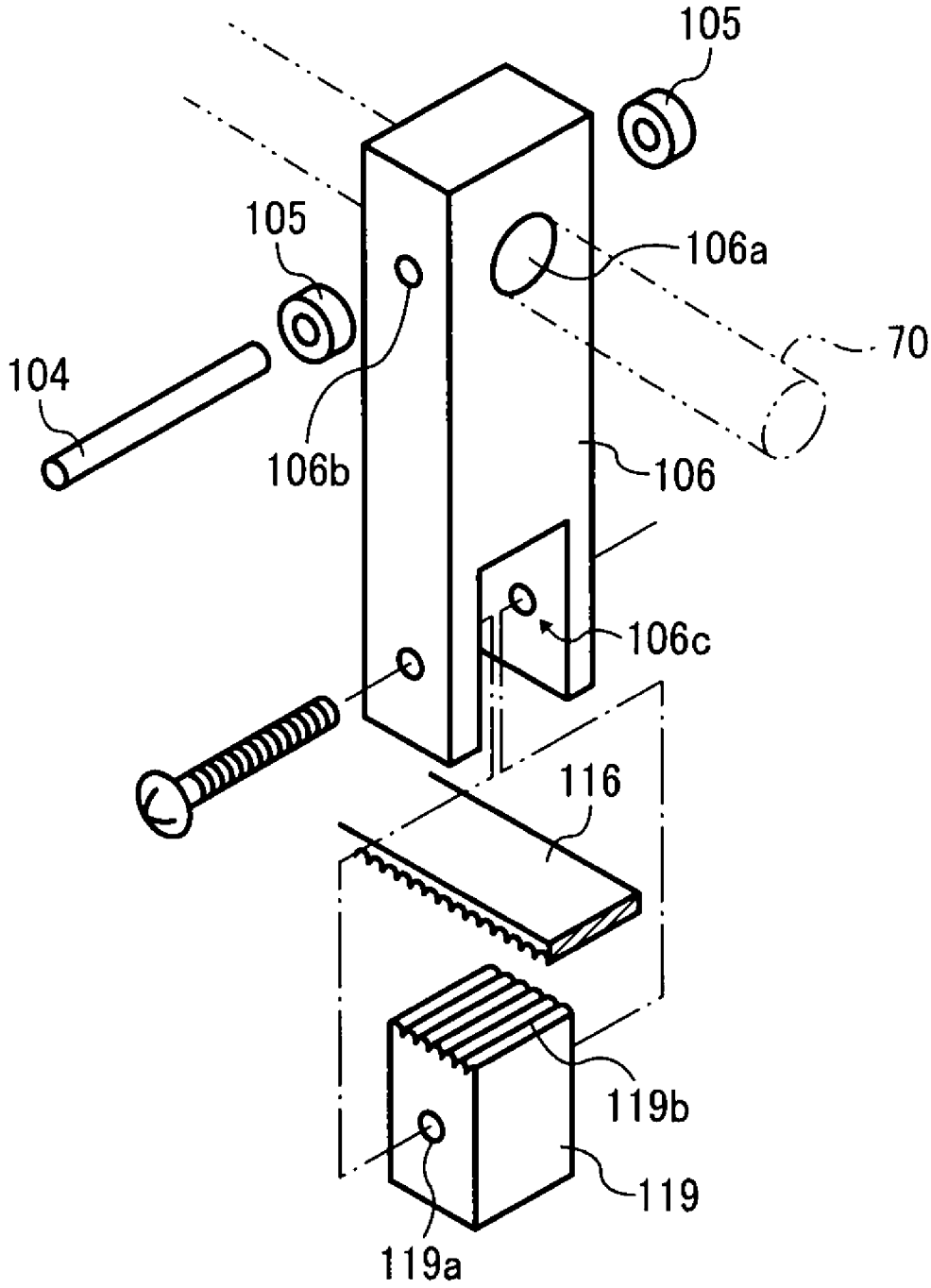
FIG. 14 is a perspective view of a drive belt and a guide shaft according to an illustrative embodiment of the present invention.

As illustrated in FIGS. 13 and 14, a drive arm 106 engages the guide shaft 70. In particular, an insertion hole 106*a*, through which the guide shaft 70 is inserted, is provided substantially at an upper portion of the drive arm 106. Furthermore, the drive arm 106 includes another hole 106*b*, different from the insertion hole, in the direction perpendicular to the insertion hole 106*a*. A shaft pin 104 is fitted into the hole 106*b*.

The shaft pin 104 is fit into a through hole, not illustrated, provided to the guide shaft 70. The shaft pin 104 is disposed perpendicular to the guide shaft 70. Rollers 105 are rotatably provided at both ends of the shaft pin 104 so as to travel on the rails 100 and 101. The rollers 105 are secured by E-type retaining rings, not illustrated, preventing the rollers 105 from falling off from the shaft pin 104.

When the rollers 105 are provided at both ends of the shaft pin 104 pressed into the guide shaft 70 and travel on the rails 100 and 101, the piston 55 provided to the guide shaft 70 is prevented from rotating. In other words, the rollers 105 contact at least one of the rails 100 or 101, thereby preventing the piston 55 from rotating.

Next, a description is provided of a driving mechanism of the piston 55. As illustrated in FIGS. 8, 11, and 12, a stepping motor 110 is provided as a drive source in the air supply device 500 according to the illustrative embodiment.

The stepping motor 110 includes a pulley 111 fixed to a motor shaft of the stepping motor 110. A drive shaft 112 is pivotally supported between the front panel 50 and the rear panel 51. Another pulley, that is, a pulley 113, is mounted and fixed to the drive shaft 112.

A first drive belt 115 serving as a timing belt is stretched between the pulley 111 and the pulley 113.

A drive pulley 114 is fixed to the drive shaft 112. An idler shaft 117 is pivotally supported parallel to the drive shaft 112 between the front panel 50 and the rear panel 51. An idler pulley 118 is fixed to the idler shaft 117. A second drive belt 116 serving as a timing belt is stretched between the drive pulley 114 and the idler pulley 118.

As illustrated in FIGS. 13 and 14, the drive arm 106 connected to the guide shaft 70 includes a belt mounting portion 106*c* at the bottom of the drive arm 106. The belt mounting portion 106*c* is formed such that the bottom of the drive arm is cut out in a reverse U-shape. The upper portion of the second drive belt 116 is provided in the belt mounting portion 106*c* and fastened thereto by a screw so that the drive arm 106 is fixed to the second drive belt 116.

In order to securely hold the drive belt 116, a holding member 119 including a through hole 119*a* presses the drive belt 116 against the drive arm 106 and is fastened by the screw. The through hole 119*a* is a long hole through which the screw is inserted.

An upper surface 119*b* of the holding member 119 has a rugged surface corresponding to a shape of an inner surface of the second drive belt 116 so as not to slip when the second drive belt 116 is fastened thereto.

With this configuration, rotation of the stepping motor 110 is transmitted to the drive shaft 112 through the first drive belt 115, and further transmitted from the drive shaft 112 to the drive arm 106 through the second drive belt 116, causing the guide shaft 70 connected to the drive arm 106 to move in the left and the right directions in FIGS. 8, 10, and 12. As a result, the piston 55 travels in the cylinder 53.

According to the illustrative embodiment, the stepping motor 10 is used as the drive source. The number of steps for the stepping motor 10 is configured such that the piston 55 travels between the home position illustrated in FIGS. 8 and 10 and a compression position (top dead center). The home position according to the illustrative embodiment refers to a bottom dead center at which the volume of the cylinder 53 is at maximum. The compression position (top dead center) of the piston 55 herein refers to a position at which a volume of the cylinder 53 is at minimum.

When power is turned on, the position of the home position is verified based on an output of the detector 95, and the piston 55 is halted at the home position. Based on that position, the stepping motor 110 rotates in a counterclockwise direction (normal rotation) in FIG. 8, such that the piston 55 travels in the compression direction by the number of steps being set.

Subsequently, the stepping motor 110 rotates such that the piston 55 moves by the same number of strokes in the opposite direction, that is, the clockwise direction in FIG. 8 so that the piston 55 returns to the home position. As described above, with reciprocal motion of the piston 55, the air supply operation including air compression, air supply, and air induction is performed.

Figure 15:
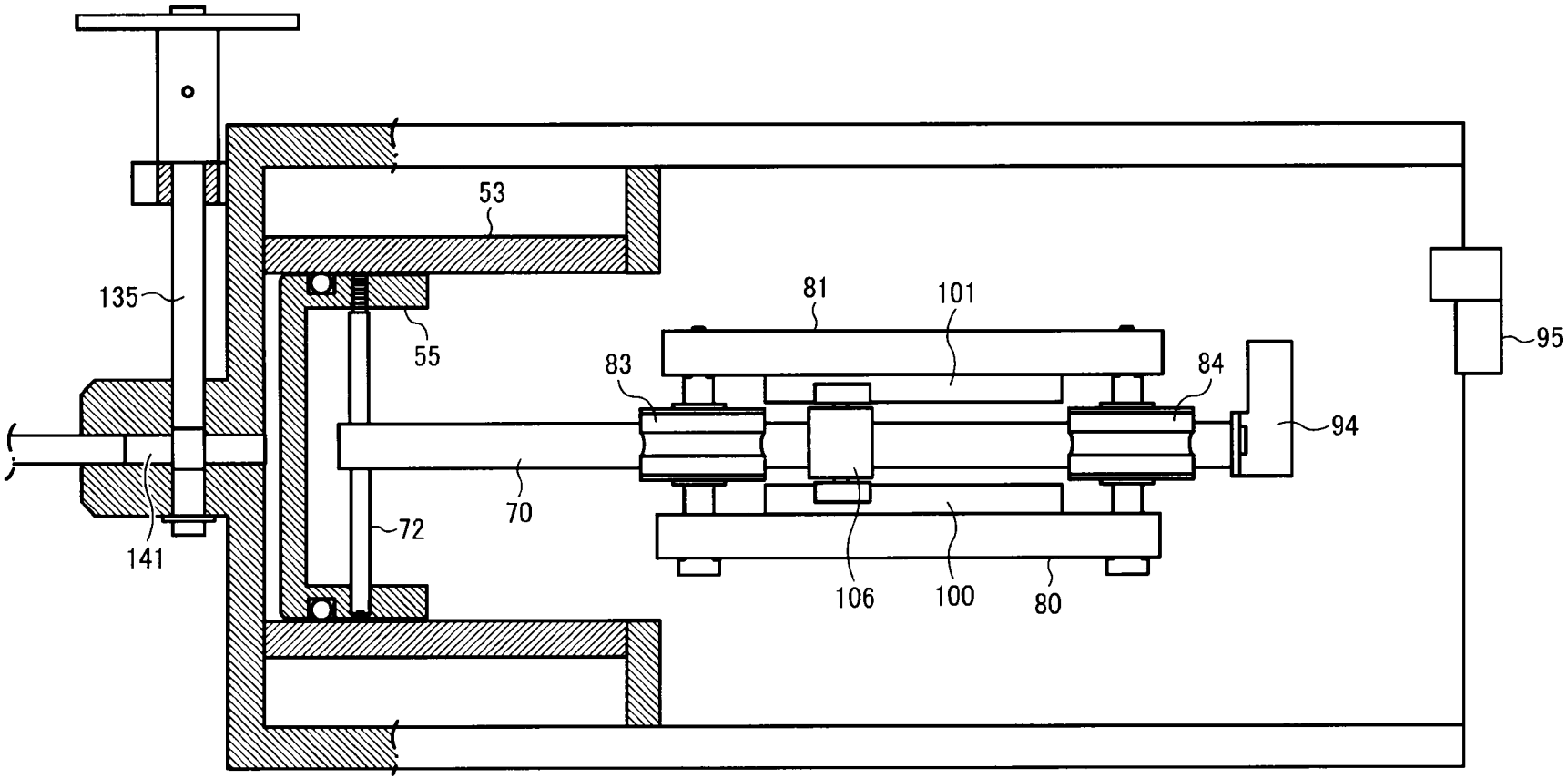
FIG. 15 is a horizontal cross-sectional view of a piston of the air supply device at a compression position (top dead center) according to an illustrative embodiment of the present invention.
Figure 16:
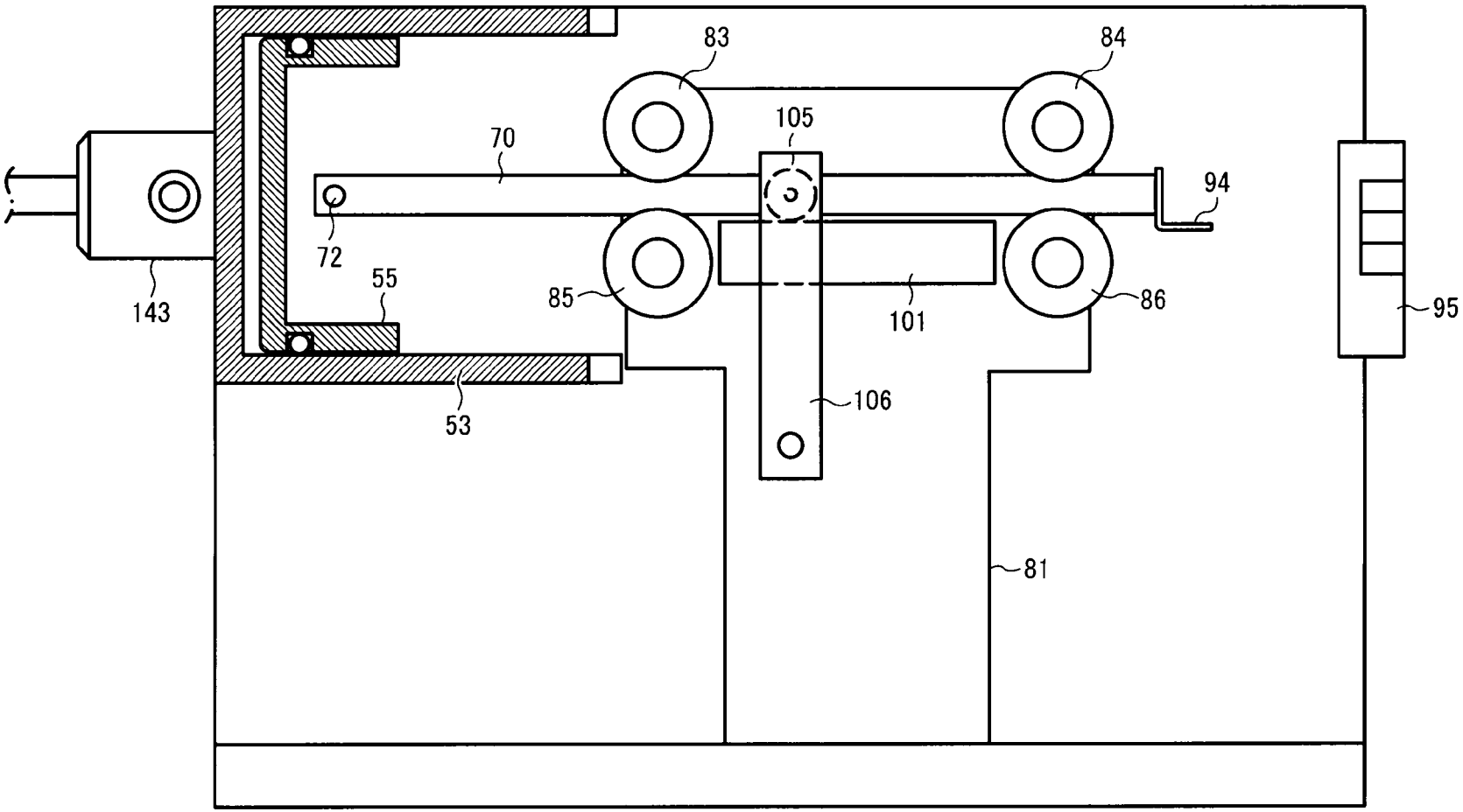
FIG. 16 is a front sectional view of the piston at the compression position (top dead center) according to an illustrative embodiment of the present invention.
Figure 17:
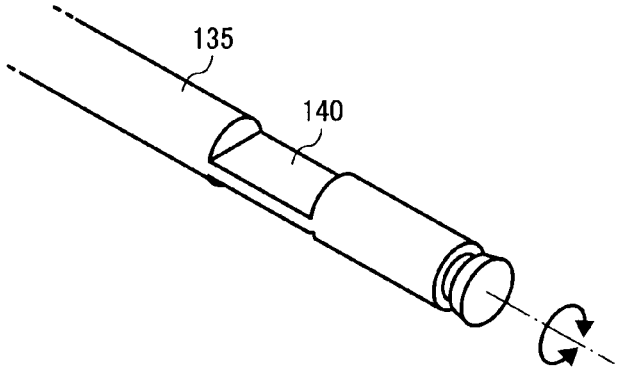
FIG. 17 is a partially exploded perspective view of a switching shaft serving as a sealing member in the air supply device according to an illustrative embodiment of the present invention.

FIGS. 15 and 16 illustrate the piston 55 at the compression position. FIG. 15 is a horizontal sectional view of the piston 55. FIG. 16 is a vertical sectional view of the piston 55.

The piston 55 includes an air inlet, not illustrated, on the front end surface thereof. The air inlet communicates the inside and the outside of the piston 55.

In order to seal the inlet, a substantially triangular leaf valve, not illustrated, is fixed to the front end surface of the piston 55 through a holding member, not illustrated.

When the piston 55 travels in the compression direction (in the direction to the left in FIGS. 8 and 10), the leaf valve closely contacts the front end surface of the piston 55, sealing the inlet 158, thereby preventing the air from leaking inside the piston 55.

By contrast, when the piston 55 travels back in the expansion direction (in the direction to the right in FIGS. 15 and 16), the leaf valve is pushed open, thereby drawing air from the piston 55 to inside the cylinder 53.

As described above, associated with movement of the piston, air is drawn inside the cylinder.

According to the illustrative embodiment, the leaf valve is provided to the front end surface of the piston 55. Alternatively, the valve is provided to the cylinder 53, for example, to the end surface of the cylinder head.

If air does not accumulate in the cylinder 53 as the piston 55 travels in the compression direction, that is, if air is ejected as the piston 55 travels, a high air ejection pressure is not achieved, thus making it impossible to eject air with high pressure.

In view of this, according to the illustrative embodiment, as illustrated in FIG. 10, a tabular portion 140 is provided to an air outlet 141 of the cylinder 53. The tabular portion 140 serves as a sealing member, and opens and closes the air outlet 141 at a predetermined timing. That is, the tabular portion 140 remains closed until a predetermined time comes, thereby increasing the air ejection pressure and thus enabling the air to be ejected under high pressure. As illustrated in FIG. 10, the boss 143 provided with the air outlet 141 includes a through-hole 144 perpendicular to the air outlet 141. According to the illustrative embodiment, the through-hole 144 is circular, and a switching shaft 135 having a cylinder shape is inserted therethrough. The switching shaft 135 is inserted through and rotatably supported by a shaft bearing 138 and the through-hole 144. The shaft bearing 138 is fitted into a protrusion 137 provided to the side surface of the air supply device 500.

An E-type retaining ring is provided to one end of the switching shaft 135, that is, the bottom end portion thereof. At the other end of the switching shaft 135, a disk 134 and a cylinder portion 134*a* are fixed thereto. With this configuration, the switching shaft 135 is positioned in the shaft direction and prevented from falling off.

The switching shaft 135 includes the tabular portion 140 at a position corresponding to the air outlet 141. The tabular portion 140 is formed such that a portion of the switching shaft 135 is cut out and flattened. According to the illustrative embodiment, both sides of the switching shaft 135 are cut out in the same shape, and the flat surface (the tabular portion) is positioned in the shaft center.

When the tabular portion 140 is oriented in the vertical direction as illustrated in FIG. 10, the tabular portion 140 closes the air outlet 141, thereby preventing air in the cylinder 53 from being ejected from the air outlet 141.

By contrast, when the tabular portion 140 rotates facing in the horizontal direction, the air outlet 141 is opened, thereby allowing air inside the cylinder 53 to be supplied from the air outlet 141 passing both sides of the tabular portion 140.

According to the illustrative embodiment, when the switching shaft 135 is rotated by 90 degrees, the direction of the tabular portion 140 is switched between the vertical direction and the horizontal direction, thereby opening and closing the air outlet 141. Furthermore, when the air outlet 141 is opened at the predetermined timing (the air outlet 141 is closed until the predetermined time comes), the air pressure in the cylinder 53 can be increased, thus being able to eject air with high pressure.

Figure 18:
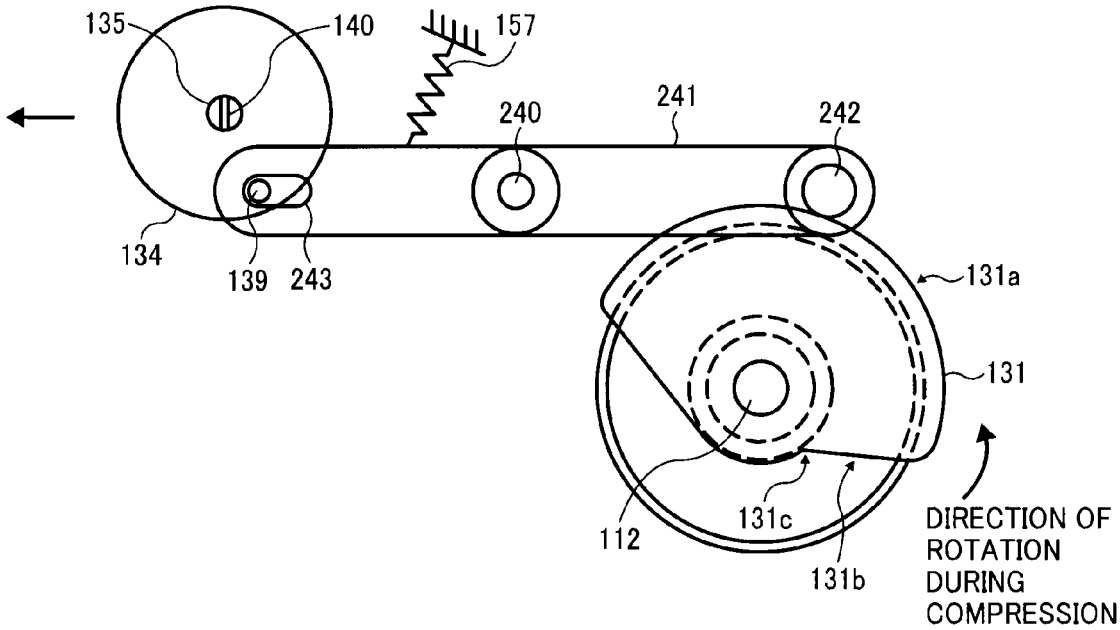
FIG. 18 is a front view of a switching mechanism when the piston is at the home position according to an illustrative embodiment of the present invention.

Referring now to FIG. 18, there is provided a front view of a switching mechanism that causes the air outlet 141 of the air supply device 500 to open and close in order to increase air pressure inside the cylinder 53.

As illustrated in FIG. 18, the switching mechanism includes a cam 131, a roller 242, a link lever 241, a shaft 240, a pull spring 157 and so forth.

The cam 131 is fixed substantially at the rear of the drive shaft 112. As illustrated in FIG. 18, the cam 131 has a substantially fan-like shape and includes an arc portion 131*a* and a linear portion 131*b*. It is to be noted that a connecting portion where the arc portion 131*a* and the linear portion 131*b* meet is rounded so as to enable the roller 242 (a cam follower), described later, to move smoothly.

Referring back to FIG. 11, the shaft 240 is fixed on the outer surface of the rear panel 51 and protrudes therefrom. The link lever 241 is pivotally provided to the shaft 240.

As illustrated in FIG. 18, the link lever 241 is a relatively long and narrow plate member with one end thereof pivotally provided with the roller 242 serving as a cam follower. The other end of the link lever 241 includes a slot 243 through which a connecting pin 139 is freely fitted. The connecting pin 139 is provided substantially on the end surface of the disk 134 fixed to one end of the switching shaft 135 and protrudes therefrom.

A pull spring 157 is provided between the link lever 241 and the device chassis, such that the pull spring 157 urges the link lever 241 so as to press the roller 242 against the peripheral surface of the cam 131. Accordingly, when the cam 131 rotates, the roller 242 rotates as well, thereby causing the link lever 241 to swing. When the link lever 241 swings, the disk 134 rotates by a predetermined amount (degree) through the connecting pin 139.

According to the illustrative embodiment, the cam mechanism described above is configured such that the disk 134 rotates through an arc of approximately 90 degrees.

FIG. 18 illustrates a state in which the piston 55 of the air supply device 500 is at the home position. When the piston 55 is at the home position, the link lever 241 is substantially horizontal and the connecting pin 139 is positioned at the right bottom end of the disk 134. The tabular portion 140 provided to the switching shaft 135 faces in the vertical direction so as to seal the air outlet 141 as illustrated in FIG. 10.

When the drive shaft 112 rotates in the counterclockwise direction as indicated by an arrow in FIG. 18, the piston 55 moves in the compression direction. Along with the piston 55 moving in the compression direction, the cam 131 rotates in the counterclockwise direction from the position in FIG. 18.

Figure 19:
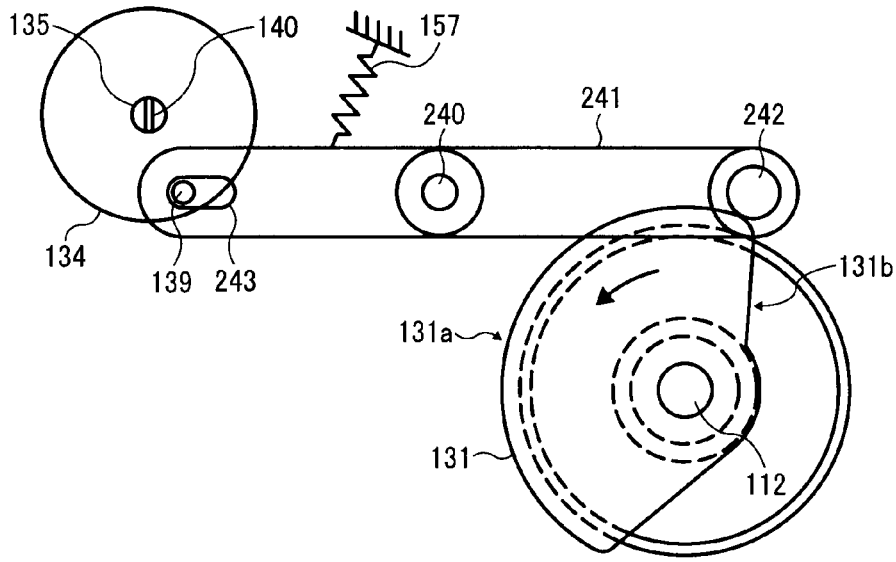
FIG. 19 is a front view of the switching mechanism when the piston is at top dead center according to an illustrative embodiment of the present invention.

As long as the arc portion 131*a* slidably moves on the roller 242, that is, until the arc portion 131*a* comes to the position shown in FIG. 19, the position of the roller 242 remains unchanged. Thus, the disk 134 does not rotate, and the air outlet 141 remains sealed. Accordingly, as the piston 55 moves, the pressure inside the cylinder 53 increases.

Furthermore, the cam 131 rotates from the position shown in FIG. 19, and the roller 242 separates from the arc portion 131*a*. In other words, when the roller 242 slidably contacts the linear portion 131*b*, the link lever 241 rotates in the clockwise direction due to the force of the spring 157.

Subsequently, the connecting pin 139 in the slot 243 is pressed, causing the disk 134 to rotate in the counterclockwise direction in FIG. 19. Accordingly, the switching shaft 135 (and the tabular portion 140) rotates, thereby opening the air outlet 141 as illustrated in FIG. 20.

The rotation angle of the cam 131, that is, the degree to which the roller 242 separates from the arc portion 131*a* and travels to an inner end portion 131*c* of the linear portion 131*b*, is very small in terms of traveling distance of the piston 55. Therefore, the air outlet 141 can be opened within a short period of time, releasing the air compressed inside the cylinder 53, thereby enabling the air to be ejected with great force.

According to the illustrative embodiment, the rotation arc of the cam 131 during reciprocal movement of the piston 55 is 126 degrees. When the cam 131 rotates by 92 degrees from the home position as shown in FIG. 18, which is approximately ¾ of the rotation range of the cam 31, the air outlet 141 starts to open. When the cam 131 rotates the remaining 34 degrees, which is approximately ¼ of the rotation range, the air outlet 141 opens completely.

Figure 20:
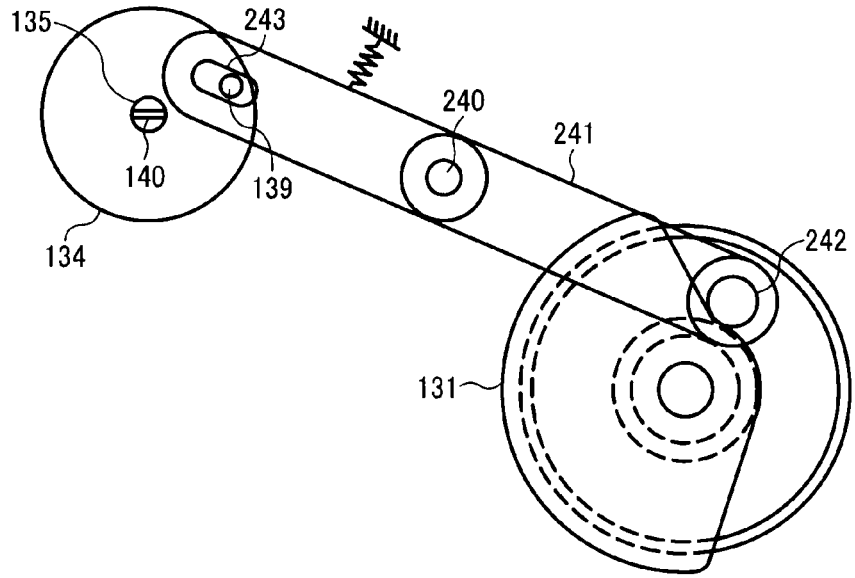
FIG. 20 is a front view of the switching mechanism while the piston is moving.

Referring now to FIG. 20, there is provided a schematic diagram illustrating the cam mechanism when the piston 55 is at the maximum compression position (top dead center).

The cam 131 does not rotate any further in the counterclockwise direction from this position illustrated in FIG. 20. While the piston 55 returns from the maximum compression position to the home position, the cam 131 rotates in the clockwise direction, that is, in the direction opposite the compression direction.

When the cam 131 rotates in the opposite direction, the roller 242 is pushed up by the linear portion 131*b* of the cam 131, causing the link lever 241 to rotate in the counterclockwise direction in FIG. 19. Accordingly, the disk 134 rotates in the clockwise direction, thereby closing the air outlet 141.

After the air outlet 141 is closed, the air outlet 141 remains closed as long as the arc portion 131*a* slidably moves on the roller 242 (from the position shown in FIG. 19 to the position shown in FIG. 18).

According to the illustrative embodiment, the sealing member mechanically connected to the piston is provided to the air outlet, and the air outlet is closed until the predetermined timing during the compression process. The air outlet can be opened in a short time near top dead center, thereby enabling the air pressure to increase and thus ejecting the highly compressed air with great force.

Conventionally, a compressor, an air tank, and an air supply system or an air supply device including a solenoid valve tend to be large. Thus, such an air supply system is used in a large device for industrial use only. However, the air supply device of the present invention employs a small air pump instead of a conventional compressor. The air supply device equipped with the small-size air pump mechanically connected with the sealing member eliminates the need for the air tank and the solenoid valve. With this configuration, reduction in size and cost can be achieved.

Furthermore, noise such as that often generated in the compressor is not generated, and thus the air supply device can be used in a generally known image forming apparatus for office use. According to the illustrative embodiment, the air supply device 500 is substantially smaller than the fixing unit 40. The air supply device 500 can be provided to the image forming apparatus, for example, the printer illustrated in FIG. 1.

According to the illustrative embodiment, a fluorine-impregnated material is used for the cylinder 53 and the piston 55 of the air supply device 500. Since fluoro-resin is generally expensive, resin including fluorine powder added to polyacetal resin can be used alternatively. Accordingly, slidability is improved, and abrasion can be prevented, thereby extending product life.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

For example, the fixing unit may employ a fixing method using a heat roller, instead of a fixing belt. The heating device is not limited to a halogen heater or the like. The heating device may employ an induction heating method, and so forth.

Furthermore, the size, the shape, the location, and the angle of the nozzle for ejecting air for sheet separation can be arbitrarily set. The distance between the registration roller to the fixing nip, and the sheet transport speed can be arbitrarily set as well.

The image forming apparatus is not limited to the tandem-type image forming apparatus as illustrated in FIG. 1. In stead, a plurality of developing devices can be provided around a single image bearing member, or a revolver developing device can be employed.

The present invention is applicable not only to the image forming apparatus of the non-direct transfer method, but also an image forming apparatus of a direct transfer method. Furthermore, the present invention is applicable to a monochrome image forming apparatus in addition to the color image forming apparatus.

The image forming apparatus includes, but is not limited to a printer, a copying machine, a facsimile machine, and a multi-function machine including at least two of these functions.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

TABLE 1

| TRANSPORTED SHEET | SHEET TRANSPORT TIME (sec) MEASUREMENT NO. | | |
|---|---|---|---|
| NUMBER | 1 | 2 | 3 |
| 1 | 0.740 | 0.741 | 0.746 |
| 2 | 0.741 | 0.746 | 0.740 |
| 3 | 0.746 | 0.741 | 0.740 |
| 4 | 0.744 | 0.744 | 0.741 |
| 5 | 0.741 | 0.743 | 0.744 |
| AVERAGE | 0.7424 | 0.7430 | 0.7422 |
| STANDARD DEVIATION | 0.0025 | 0.0021 | 0.0027 |
| $+-3\sigma$ | 0.0075 | 0.0064 | 0.0080 |

TABLE 2

| PISTON SPEED (NUMBER OF | TIME FOR AIR SUPPLY UNIT TO START OPERATION AFTER DETECTION OF ON-SIGNAL OF REGISTRATION MOTOR (ms) | | | | | | | | | | | | | | | | | | |
|---|---|---|---|---|---|---|---|---|---|---|---|---|---|---|---|---|---|---|---|
| STROKES/min) | 680 | 690 | 700 | 710 | 720 | 730 | 740 | 750 | 760 | 770 | 780 | 790 | 800 | 810 | 820 | 830 | 840 | 850 | 860 |
| 120 | N | N | Y | Y | Y | Y | Y | Y | Y | Y | N | N | N | N | N | N | N | N | N |
| 130 | N | N | N | N | N | N | Y | Y | Y | Y | Y | Y | Y | Y | Y | Y | N | N | N |
| 140 | N | N | N | N | Y | Y | Y | Y | Y | Y | Y | Y | Y | Y | Y | Y | Y | N | N |

Y = SEPARATED
N = NOT SEPARATED

What is claimed is:

1. An image forming apparatus, comprising:

an image forming station including an image bearing member to bear an electrostatic latent image on a surface thereof, a charging device to charge the image bearing member to form the electrostatic latent image, and a developing device to develop the electrostatic latent image formed on the image bearing member using toner to form a toner image;

a registration member to feed the recording medium in appropriate timing such that the recording medium is aligned with the toner image formed in the image forming station;

a registration motor to drive the registration member; and a fixing unit to fix the toner image on the recording medium, the fixing unit including a rotary heating member to heat the recording medium;

a rotary pressure member to contact and press against the rotary heating member forming a fixing nip portion where the rotary heating member and the rotary pressure member meet; and a sheet separator to eject air to separate the recording medium from the rotary heating member according to a drive signal of the registration motor, wherein the sheet separator detects an amount of a sheet margin of a leading edge of the recording medium and ejects air when the amount of the sheet margin at the leading edge of the recording medium is less than a threshold amount.

2. The image forming apparatus according to claim 1, further comprising an image reader to read an image on a document, wherein the amount of the sheet margin at the leading edge of the recording medium is determined based on the sheet margin at the leading edge of the document read by the image reader.

3. The image forming apparatus according to claim 1, wherein the registration motor is a stepping motor.

4. The image forming apparatus according to claim 1, further comprising an air supply device to supply air to the sheet separator.

5. The image forming apparatus according to claim 4, wherein the air supply device includes a pump including an air outlet, a cylinder, and a piston that reciprocally moves within the cylinder;

a sealing member to open and close the air outlet, provided to the air outlet; and a switching unit to keep the sealing member closed until the piston arrives at a predetermined position when compressing air, and open the sealing member when the piston arrives at the predetermined position, the switching unit mechanically connected to both the piston and the sealing member.

6. The image forming apparatus, according to claim 1, wherein at least one of the rotary heating member and the rotary pressure member is an endless belt.

7. An image forming apparatus, comprising:

an image forming station including an image bearing member to bear an electrostatic latent image on a surface thereof, a charging device to charge the image bearing member to form the electrostatic latent image, and a developing device to develop the electrostatic latent image formed on the image bearing member using toner to form a toner image;

a registration member to feed the recording medium in appropriate timing such that the recording medium is aligned with the toner image formed in the image forming station;

a registration motor to drive the registration member; and a fixing unit to fix the toner image on the recording medium, the fixing unit including a rotary heating member to heat the recording medium;

a rotary pressure member to contact and press against the rotary heating member forming a fixing nip portion where the rotary heating member and the rotary pressure member meet; and a sheet separator to eject air to separate the recording medium from the rotary heating member according to a drive signal of the registration motor, wherein the rotary pressure member and the sheet separator constitute a single integrated unit.

8. The image forming apparatus according to claim 7, wherein the registration motor is a stepping motor.

9. The image forming apparatus according to claim 7, further comprising an air supply device to supply air to the sheet separator.

10. The image forming apparatus according to claim 9, wherein the air supply device includes a pump including an air outlet, a cylinder, and a piston that reciprocally moves within the cylinder;

a sealing member to open and close the air outlet, provided to the air outlet; and a switching unit to keep the sealing member closed until the piston arrives at a predetermined position when compressing air, and open the sealing member when the piston arrives at the predetermined position, the switching unit mechanically connected to both the piston and the sealing member.

11. The image forming apparatus, according to claim 6, wherein at least one of the rotary heating member and the rotary pressure member is an endless belt.

12. An image forming apparatus, comprising:

image forming means including an image bearing member to bear an electrostatic latent image on a surface thereof, a charging device to charge the image bearing member to form the electrostatic latent image, and a developing device to develop the electrostatic latent image formed on the image bearing member using toner to form a toner image;

registration means for feeding the recording medium in appropriate timing such that the recording medium is aligned with the toner image formed in the image forming means;

driving means for driving the registration means; and fixing means for fixing the toner image on the recording medium, the fixing means comprising:

rotary heating means for heating the recording medium;

rotary pressing means for contacting and pressing against the rotary heating means to form a fixing nip portion where the rotary heating means and the rotary pressing means meet; and sheet separation means for ejecting air to separate the recording medium from the rotary heating means according to a drive signal of the driving means, and according to detection of an amount of a sheet margin of a leading edge of the recording medium, wherein the sheet separation means ejects air when the amount of the sheet margin at the leading edge of the recording medium is less than a threshold amount.

13. The image forming apparatus according to claim 12, further comprising image reading means to read an image on a document, wherein the amount of the sheet margin at the leading edge of the recording medium is determined based on the sheet margin at the leading edge of the document read by the image reading means.

14. An image forming apparatus, comprising:

image forming means including an image bearing member to bear an electrostatic latent image on a surface thereof, a charging device to charge the image bearing member to form the electrostatic latent image, and a developing device to develop the electrostatic latent image formed on the image bearing member using toner to form a toner image;

registration means for feeding the recording medium in appropriate timing such that the recording medium is aligned with the toner image formed in the image forming means;

driving means for driving the registration means; and fixing means for fixing the toner image on the recording medium, the fixing means comprising:

rotary heating means for heating the recording medium;

rotary pressing means for contacting and pressing against the rotary heating means to form a fixing nip portion where the rotary heating means and the rotary pressing means meet; and sheet separation means for ejecting air to separate the recording medium from the rotary heating means according to a drive signal of the driving means, wherein the rotary pressing means and the sheet separation means constitute a single integrated unit.

* * * * *